US009426846B2

(12) United States Patent
Okuda et al.

(10) Patent No.: US 9,426,846 B2
(45) Date of Patent: Aug. 23, 2016

(54) INDUCTION HEATING APPARATUS

(75) Inventors: Sunao Okuda, Shiga (JP); Naoaki Ishimaru, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 780 days.

(21) Appl. No.: 13/814,382

(22) PCT Filed: Aug. 29, 2011

(86) PCT No.: PCT/JP2011/004786

§ 371 (c)(1),
(2), (4) Date: Feb. 5, 2013

(87) PCT Pub. No.: WO2012/029277

PCT Pub. Date: Mar. 8, 2012

(65) Prior Publication Data

US 2013/0140297 A1 Jun. 6, 2013

(30) Foreign Application Priority Data

Aug. 30, 2010 (JP) ..... 2010-191794
Oct. 27, 2010 (JP) ..... 2010-240465
Oct. 28, 2010 (JP) ..... 2010-241632

(51) Int. Cl.
*H05B 6/06* (2006.01)
*H05B 6/12* (2006.01)

(52) U.S. Cl.
CPC ..... *H05B 6/062* (2013.01); *H05B 6/1209* (2013.01); *H05B 2213/07* (2013.01)

(58) Field of Classification Search
CPC ... H05B 6/062; H05B 6/1209; H05B 2213/07
USPC ..... 219/446.1, 497, 502, 620, 626, 627; 250/216, 332, 338.1, 342
See application file for complete search history.

(56) References Cited

U.S. PATENT DOCUMENTS 6,140,617 A * 10/2000 Berkcan ..... H05B 3/746 219/446.1
2004/0099652 A1* 5/2004 Berkcan ..... H05B 3/746 219/448.11

(Continued)

FOREIGN PATENT DOCUMENTS

CN 101622905 A 1/2010
GB 2065916 A * 7/1981 ..... G02B 1/00

(Continued)

OTHER PUBLICATIONS

Extended European Search Report in corresponding European Application No. 11821299.2, dated Sep. 18, 2014, 7 pages.

(Continued)

*Primary Examiner* — Thien S Tran
(74) *Attorney, Agent, or Firm* — Brinks Gilson & Lione

(57) ABSTRACT

In an induction heating apparatus, an infrared-ray detection portion includes an infrared-ray reception portion adapted to receive infrared rays radiated from an object to be heated, an amplification portion adapted to amplify a detection signal from the infrared-ray reception portion to form an infrared-ray detection signal, and a temperature detection portion adapted to detect the temperature of the infrared-ray detection portion and to output the temperature to the control portion. The control portion is adapted to correct the infrared-ray detection signal to form an infrared-ray real signal, when the temperature of the infrared-ray reception portion is equal to or higher than a temperature to be detected by the infrared-ray detection portion, based on information about a negative signal superimposed on the infrared-ray detection signal outputted from the infrared-ray detection portion, which is negative-signal information about the negative signal with the reverse polarity from that of the infrared-ray detection signal.

17 Claims, 13 Drawing Sheets

(56) References Cited

U.S. PATENT DOCUMENTS

| | | | | |
|---|---|---|---|---|
| 2008/0179503 | A1* | 7/2008 | Camargo | H01L 31/0203 250/216 |
| 2010/0065550 | A1 | 3/2010 | Tominaga et al. | |
| 2010/0181299 | A1 | 7/2010 | Niiyama et al. | |
| 2011/0198342 | A1 | 8/2011 | Fujinami et al. | |
| 2011/0284524 | A1 | 11/2011 | Okuda et al. | |

FOREIGN PATENT DOCUMENTS

| | | | |
|---|---|---|---|
| JP | 2000-298202 | A | 10/2000 |
| JP | 2003-347028 | A | 12/2003 |
| JP | 2004-063451 | A | 2/2004 |
| JP | 2005-063881 | A | 3/2005 |
| JP | 2006-100085 | A | 4/2006 |
| JP | 2008-052959 | A | 3/2008 |
| JP | 2008-262806 | A | 10/2008 |
| JP | 2009-176553 | A | 8/2009 |
| JP | 4311154 | B2 | 8/2009 |
| JP | 2010-135299 | A | 6/2010 |
| WO | WO 2009/001540 | A1 | 12/2008 |
| WO | WO 2010/050159 | A1 | 5/2010 |
| WO | WO 2010/086923 | A1 | 8/2010 |

OTHER PUBLICATIONS

International Search Report for International Application No. PCT/JP2011/004786, dated Oct. 11, 2011, 2 pages.

International Preliminary Report on Patentability for International Application No. PCT/JP2011/004786, dated Mar. 14, 2013, 5 pages.

Search Report from corresponding Chinese patent application No. 201180041672.1 dated Aug. 4, 2014, 5 pages, and English translation.

* cited by examiner

INDUCTION HEATING APPARATUS

This application is a 371 application of PCT/JP2011/004786 having an international filing date of Aug. 29, 2011, which claims priority to JP2010-191794 filed Aug. 30, 2010, JP2010-240465 filed Oct. 27, 2010, and JP2010-241632 filed Oct. 28, 2010, the entire contents of which are incorporated herein by reference.

TECHNICAL FIELD

The present invention relates to induction heating apparatuses including induction heating cookers for use in ordinary households, restaurants, offices, and the like.

BACKGROUND ART

In recent years, there has been wide spread use of induction heating cookers for inductively heating cooking containers such as pans, frying pans and the like, using heating coils.

Conventionally, among induction heating cookers of this type, there have been known induction heating cookers employing infrared-ray detection means for detecting infrared rays radiated from cooking containers according to the temperatures thereof and for outputting infrared-ray detection signals according to the detected infrared-ray energy, in order to detect the temperatures of the cooking containers with higher accuracy.

Further, Japanese Patent No. 4311154 (Patent Literature 1) has suggested a structure which is adapted to detect the temperature of a cooking container when the cooking container is at a lower temperature (70° C.) using an infrared-ray sensor as infrared-ray detection means, and is adapted to control heating based on the detected temperature.

The infrared-ray detection means used in the induction heating cooker raises its temperature by being subjected to heat radiated from the cooking container being heated, a top plate on which the cooking container is placed, a heating coil for induction heating, and the like. In cases where the infrared-ray detection means includes a photo diode which is quantum-type infrared-ray reception means, and an operational amplifier for performing current-to-voltage conversion on electric current signals outputted from the photo diode and for amplifying the signals, if the temperature of the photo diode is raised, this lowers the resistance value of the parallel resistance (the shunt resistance) which is the internal resistance in the photo diode. If the resistance value of the parallel resistance is lowered as described above, the input offset voltage in the operational amplifier is amplified to be increased.

As a result, the amplified input offset voltage is superimposed on the infrared-ray detection signal outputted from the infrared-ray detection means, which induces the problem that the infrared-ray detection signal outputted from the infrared-ray detection means can not accurately indicate the infrared-ray energy. In order to overcome this problem for preventing degradation of the accuracy of detection of the temperature of the cooking container through the infrared-ray detection signal, JP-A No. 2008-52959 (Patent Literature 2) has suggested an induction heating cooker provided with connection control means for periodically reversing the polarity of the photocurrent outputted from a photo diode.

Ordinary induction heating cookers have been adapted to detect the temperature of a pan bottom of a cooking container and to control heating of the cooking container, using infrared-ray detection means provided under a top plate.

In an induction heating cooker, the top plate is made of a heat-resistant glass having a light transmittance of about 90% (in the case where its thickness is 4 mm) for a wavelength range of 0.5 to 2.5 μm, and the infrared-ray detection means detects infrared rays within this wavelength range. Referring to FIG. 1, a solid line indicates a characteristic curve representing a light-transmittance characteristic of a heat-resistant glass which is generally used in a top plate. Further, in FIG. 1, respective broken lines represent radiant energy from blackbodies at certain temperatures (60° C. and 140° C.). Further, there are illustrated, by hatching, the areas of radiant energy which can be received by infrared-ray detection portions, which will be described later.

Further, referring to FIG. 1, the lateral axis represents the wavelength [micrometer], while the longitudinal axis represents the light transmittance [%] and the radiation intensity [W/sr]. Here, the light transmittance, which is a value indicating the degrees of light absorbance and light reflection, represents the ratio of the amount of light which is penetrated and emitted, to the amount of incident light.

JP-A No. 2009-176553 (Patent Literature 3) has suggested an induction heating cooker employing an infrared-ray sensor as infrared-ray detection means for detecting a certain temperature range, by identifying a detection range of received infrared rays. In the induction heating cooker, the infrared-ray sensor is provided with a hemispherical lens made of a polycarbonate, in order to condense infrared rays. Since the lens is made of a resin, it is possible to reduce the cost of the infrared-ray detection means.

PLT 1: Japanese Patent No. 4311154
PLT 2: JP-A No. 2008-52959
PLT 3: JP-A No. 2009-176553

SUMMARY OF THE INVENTION

Technical Problem

The infrared-ray detection means described in Patent Literature 1 is adapted such that the temperatures to be detected are lower temperatures around 70° C. and therefore, the temperature of the infrared-ray detection means itself may come to be a temperature to be detected.

The present inventors have revealed from experiments that, when the infrared-ray detection means itself comes to be at a temperature to be detected, a negative signal (a reverse-current signal) is superimposed on the infrared-ray detection signal outputted from the infrared-ray detection means, besides the variation of the input offset voltage, which is the challenge in Patent Literature 2. Particularly, in the case where the infrared-ray detection means is adapted to detect lower temperatures equal to or lower than 100° C., such a negative signal superimposed on the infrared-ray detection signal induces a severe problem which obstructs accurate temperature detection, since less infrared-ray energy is radiated from the cooking container to be subjected to the detection. Here, the negative signal superimposed on the infrared-ray detection signal is a reverse-current signal with the reverse polarity from that of the infrared-ray detection signal outputted from the infrared-ray detection means according to the infrared-ray energy of infrared rays received by the infrared-ray detection means.

FIG. 2 is a graph illustrating an example of a negative signal outputted from an infrared-ray sensor as infrared-ray detection means, illustrating an output voltage characteristic with respect to the temperature. Referring to FIG. 2, the lateral axis represents the temperature [° C.] of the infrared-ray sensor, while the longitudinal axis represents the output voltage [V] from the infrared-ray sensor. The negative signal illustrated in FIG. 2 is the output signal of when the temperature of the infrared-ray sensor itself has been raised, in a dark state where it receives no infrared-ray energy, wherein the infrared-ray sensor is structured to output a voltage signal of 0.96 V as a reference voltage signal (Vref) in a room-temperature state (20° C.).

FIG. 3 illustrates characteristic curves resulted from detection of the temperature of a cooking container, when the infrared-ray sensor was at certain temperatures (25° C., 50° C. and 80° C.). Referring to FIG. 3, a solid line represents a characteristic curve of when the temperature of the infrared-ray sensor itself was 25° C., a broken line represents a characteristic curve of when the temperature of the infrared-ray sensor itself was 50° C., and a dashed line represents a characteristic curve of when the temperature of the infrared-ray sensor itself was 80° C.

As illustrated in FIG. 3, when the infrared-ray sensor was 80° C., the infrared-ray detection signal which was the output voltage therefrom was lower by about 0.8 V than that of when the infrared-ray sensor was 25° C. It can be seen that the negative signal was superimposed on the outputted infrared-ray detection signal, due to the rise of the temperature of the infrared-ray sensor itself to temperatures to be detected (for example, 50 to 80° C.).

As described above, in the case where an infrared-ray sensor is employed as conventional infrared ray detection means, particularly, when the temperatures to be detected are lower temperatures, such as temperatures equal to or lower than 100° C., and the infrared-ray detection means itself is being at a temperature to be detected, the infrared-ray detection means outputs an infrared-ray detection signal on which a negative signal which exerts larger influences on the infrared-ray detection signal is superimposed. This has induced the problem that it is impossible to detect, using conventional infrared-ray sensors, the temperatures of cooking containers, particularly the temperatures thereof when they are at lower temperatures.

Furthermore, for reasons which will be described later, there has been the problem that it is impossible to accurately detect, using conventional infrared-ray sensors, the temperatures of cooking containers, particularly when the temperatures to be detected are lower temperatures.

As described above, the infrared-ray sensor as conventional infrared-ray detection means disclosed in Patent Literature 3 is provided with a hemispherical lens made of a resin, which is polycarbonate, in order to condense infrared rays. Accordingly, the infrared-ray sensor is adapted to detect infrared rays having been radiated from a cooking container and having been transmitted through the top plate made of a heat-resistant glass and through the resin lens. The top plate and the lens have different light transmittance characteristics and therefore, infrared rays radiated from the cooking container are attenuated by the top plate and further, are attenuated by the lens. Since the infrared-ray sensor is adapted to detect infrared rays having been attenuated by the top plate and the lens, as described above, the infrared-ray sensor adapted to detect lower temperatures, particularly, is caused to receive less infrared-ray energy, which has induced the problem that the infrared-ray sensor can not accurately detect the temperature of the cooking container, which is an object to be heated.

The present invention was made in order to overcome the aforementioned problems of conventional induction heating cookers and aims at providing an induction heating apparatus which is capable of accurately detecting the temperature of an object to be heated, with infrared-ray detection means, even when the object to be heated is at a lower temperature (for example, equal to or lower than 100° C.), and thus, is capable of certainly heating the object to be heated in desired states. The present invention aims at providing a cooking appliance which is capable of detecting the temperature of a cooking container with high accuracy, which is an object to be heated and thus, has improved cooking performance, for example, as an induction heating cooker.

According to the present invention, it is possible to provide an induction heating apparatus which is capable of accurately detecting the temperature of an object to be heated, even when the temperature of the infrared-ray detection means itself has been raised to be equal to or higher than the temperatures to be detected by the infrared-ray detection means and, thus, a larger negative signal has been superimposed on an infrared-ray detection signal outputted from the infrared-ray detection means.

Further, according to the present invention, it is possible to provide an induction heating apparatus which is capable of detecting the temperature of an object to be heated with high accuracy, from infrared rays radiated from the object to be heated, through a condenser lens, and thus, is capable of controlling the temperature of the object to be heated with high accuracy.

Solution to Problem

An induction heating apparatus in a first aspect of the present invention includes:

a top plate for placing an object to be heated thereon;

a heating coil adapted to generate an induction magnetic field for heating the object to be heated;

a control portion adapted to control a high-frequency electric current applied to the heating coil for heating the object to be heated; and an infrared-ray detection portion which is adapted to detect an infrared ray radiated according to the temperature of the object to be heated and, further, is adapted to output an infrared-ray detection signal according to infrared-ray energy of the detected infrared ray;

wherein the infrared-ray detection portion includes an infrared-ray reception portion adapted to output a detection signal, when receiving an infrared ray radiated from the object to be heated, an amplification portion adapted to amplify the detection signal from the infrared-ray reception portion to form an infrared ray detection signal, and a temperature detection portion which is adapted to detect a temperature of the infrared-ray detection portion and is adapted to output the detected temperature to the control portion, and the control portion includes a correction portion which is adapted to correct the infrared-ray detection signal for forming an infrared-ray real signal, when the temperature of the infrared-ray detection portion is equal to or higher than a temperature to be detected by the infrared-ray detection portion, based on information about a negative signal superimposed on the infrared-ray detection signal outputted from the infrared-ray detection portion, which is negative-signal information about the negative signal with the reverse polarity from that of the infrared-ray detection signal. The induction heating apparatus having the aforementioned structure in the first aspect of the present invention is capable of detecting the temperature of the object to be heated with high accuracy, by the infrared-ray detection portion, and thus, is capable of heating the object to be heated in desired states.

In a second aspect of the present invention, in the induction heating apparatus in the first aspect, the control portion includes a temperature-characteristic storage portion adapted to preliminarily store the negative-signal information indicative of a temperature characteristic regarding the negative signal and the temperature of the infrared-ray detection portion, and the correction portion is adapted to correct the infrared-ray detection signal for forming the infrared-ray real signal, based on the temperature characteristic indicated by the negative-signal information. The induction heating apparatus having the aforementioned structure in the second aspect of the present invention is capable of detecting the temperature of the object to be heated with high accuracy, even when the temperature of the infrared-ray detection portion has been raised to be equal to or higher than a temperature to be detected by the infrared-ray detection portion and thus, a negative signal has been induced. This can improve the cooking performance of an induction heating cooker, for example.

In a third aspect of the present invention, in the induction heating apparatus in the first aspect, the control portion includes a sensitivity-characteristic storage portion adapted to preliminarily store the negative-signal information indicative of a sensitivity characteristic regarding the negative signal and a cutoff wavelength or a spectral sensitivity wavelength of the infrared-ray reception portion, and the correction portion is adapted to correct the infrared ray detection signal for forming the infrared-ray real signal, based on the sensitivity characteristic indicated by the negative-signal information. The induction heating apparatus having the aforementioned structure in the third aspect of the present invention is capable of detecting the temperature of the object to be heated with high accuracy, even when the temperature of the infrared-ray detection portion has been raised to be equal to or higher than a temperature to be detected by the infrared-ray detection portion and thus, a negative signal has been induced. This can improve the cooking performance of an induction heating cooker, for example.

In a fourth aspect of the present invention, in the induction heating apparatus in any one of the first to third aspects, the control portion may be adapted to correct an input offset voltage signal contained in the infrared-ray detection signal for forming the infrared-ray real signal.

In a fifth aspect of the present invention, in the induction heating apparatus in any one of the first to third aspects, the infrared-ray detection portion may be adapted to superimpose a constant reference voltage on the detection signal outputted from the infrared-ray reception portion.

In a sixth aspect of the present invention, the induction heating apparatus in the first aspect further may include a light interception portion adapted to prevent the infrared-ray reception portion from receiving an infrared ray radiated from the object to be heated, wherein the control portion may include a changeover portion adapted to manipulate the light interception portion for changing over between reception of an infrared ray radiated from the object to be heated by the infrared-ray reception portion and interception of the infrared ray, and a correction portion which is adapted to detect the negative signal superimposed on the infrared-ray detection signal, based on an output difference between an output signal from the infrared-ray reception portion when the infrared-ray reception portion receives an infrared ray radiated from the object to be heated and an output signal from the infrared-ray reception portion when an infrared ray radiated from the object to be heated is intercepted and, further, is adapted to correct the infrared-ray detection signal based on the detected negative signal for forming the infrared-ray real signal, when the temperature of the infrared-ray detection portion is equal to or higher than a temperature to be detected by the infrared-ray detection portion. The induction heating apparatus having the aforementioned structure in the sixth aspect of the present invention is capable of detecting the temperature of the object to be heated with high accuracy, even when the temperature of the infrared-ray detection portion has been raised to be equal to or higher than a temperature to be detected by the infrared-ray detection portion and, thus, a negative signal has been induced in the infrared-ray detection portion.

In a seventh aspect of the present invention, in the induction heating apparatus, the infrared-ray detection portion in the first aspect further may include a first infrared-ray reception portion which is adapted to detect an infrared ray radiated from the object to be heated according to the temperature of the object to be heated and, further, is adapted to output an infrared-ray detection signal according to infrared ray energy of the detected infrared ray, a second infrared-ray reception portion which is placed near the first infrared-ray reception portion, further is shielded in such a way as to be prevented from receiving an infrared ray according to the temperature of the object to be heated and is adapted to output a dark signal, and a correction portion which is adapted to detect the negative signal superimposed in the infrared-ray detection signal, based on an output difference between an infrared-ray detection signal from the first infrared-ray reception portion and the dark signal from the second infrared-ray reception portion and, further, is adapted to correct the infrared-ray detection signal based on the detected negative signal for forming the infrared-ray real signal, when the temperature of the infrared-ray detection portion is equal to or higher than a temperature to be detected by the infrared-ray detection portion. The induction heating apparatus having the aforementioned structure in the seventh aspect of the present invention is capable of detecting the temperature of the object to be heated with high accuracy, even when the temperature of the infrared-ray detection portion has been raised to be equal to or higher than a temperature to be detected by the infrared-ray detection portion and, thus, a negative signal has been induced in the infrared ray detection portion.

In an eighth aspect of the present invention, in the induction heating apparatus in any one of the first to seventh aspects, the infrared-ray detection portion may be adapted to condense, by a Fresnel lens, an infrared ray radiated from the object to be heated and, further, is adapted to output a detection signal from the infrared-ray reception portion. The induction heating apparatus having the aforementioned structure in the eighth aspect of the present invention is capable of detecting the temperature of the object to be heated with high accuracy, based on infrared rays radiated from the object to be heated, through the condenser lens, and, thus, is capable of performing control of the temperature of the object to be heated, with higher accuracy.

In a ninth aspect of the present invention, in the induction heating apparatus in any one of the first to seventh aspects, the infrared-ray detection portion may be provided under the top plate and, further, may be adapted such that an infrared ray radiated from the object to be heated is incident to the infrared-ray detection portion through the top plate, further the incident infrared ray is condensed by a Fresnel lens having a different transmittance characteristic from that of the top plate and, further, a detection signal is outputted from the infrared-ray reception portion. The induction heating apparatus having the aforementioned structure in the ninth aspect of the present invention is capable of detecting the temperature of the object to be heated with high accuracy, based on infrared rays radiated from the object to be heated, through the top plate and the condenser lens, and, thus, is capable of performing control of the temperature of the object to be heated, with higher accuracy. The induction heating apparatus in the ninth aspect of the present invention is capable of detecting the temperature of the object to be heated with high accuracy, even when the top plate and the condenser lens have different transmittance characteristics. This can improve the cooking performance of an induction heating cooker, for example.

In a tenth aspect of the present invention, in the induction heating apparatus in any one of the first to seventh aspects, the infrared-ray detection portion may be provided on the top plate and, further, may be adapted such that an infrared ray radiated from the object to be heated is incident to the infrared-ray detection portion, further the incident infrared ray is condensed by a Fresnel lens and, further, a detection signal is outputted from the infrared-ray reception portion. The induction heating apparatus having the aforementioned structure in the tenth aspect of the present invention is capable of detecting the temperature of the object to be heated with high accuracy, based on infrared rays radiated from the object to be heated, through the condenser lens, and thus, is capable of performing control of the temperature of the object to be heated, with higher accuracy.

In an eleventh aspect of the present invention, in the induction heating apparatus in any one of the first to seventh aspects, preferably, the infrared-ray detection portion is adapted such that an infrared ray radiated from the object to be heated is incident to the infrared-ray detection portion, further the incident infrared ray is condensed by a Fresnel lens and, further, a detection signal is outputted from the infrared-ray reception portion, and the Fresnel lens is made of a resin. In the induction heating apparatus having the aforementioned structure in the eleventh aspect of the present invention, the infrared-ray detection portion can be structured with lower costs, in comparison with those employing conventional condenser lenses made of glasses.

In a twelfth aspect of the present invention, in the induction heating apparatus in any one of the first to seventh aspects, preferably, the infrared-ray detection portion is adapted such that an infrared ray radiated from the object to be heated is incident to the infrared-ray detection portion, further the incident infrared ray is condensed by a Fresnel lens and, further, a detection signal is outputted from the infrared-ray reception portion, and the Fresnel lens has a thickness of 1 mm or less. The induction heating apparatus in the twelfth aspect of the present invention is capable of minimizing the attenuation in the condenser lens and thus, is capable of detecting the temperature of the object to be heated with high accuracy, even when the top plate and the condenser lens have different transmittance characteristics. This can improve the cooking performance of an induction heating cooker, for example.

In a thirteenth aspect of the present invention, in the induction heating apparatus in any one of the aforementioned first to seventh aspects, the infrared-ray detection portion may be of a quantum type.

For example, in the case where the infrared-ray detection portion is structured to detect infrared rays radiated from a cooking container as the object to be heated, through the top plate, heat from the cooking container is conducted to the top plate through heat conduction and therefore, the infrared-ray reception portion receives infrared rays having been radiated from the cooking container and having transmitted through the top plate and further, receives infrared rays radiated from the top plate. Accordingly, in detecting only the temperature indicated by infrared rays from the cooking container which have been transmitted through the top plate, the infrared rays radiated from the top plate induce detection errors.

In the case of a thermal-type infrared-ray reception portion which utilizes its electric characteristics which are changed with the temperature rise in this device, such as a thermistor, it has lower sensitivity and lower response speeds, but has sensitivity to infrared rays in a wider wavelength range. On the other hand, in the case of a quantum-type infrared-ray reception portion which utilizes electric phenomena which are induced by optical energy, such as a photo diode, it has higher detection sensitivity and, further, is excellent in response speed. Further, a quantum-type infrared-ray reception portion made of a compound semiconductor has a property of being changed in sensitivity wavelength by being changed in composition and composition ratio. Therefore, by employing such a quantum-type infrared-ray reception portion and by causing the infrared-ray reception portion to have sensitivity wavelengths coincident to wavelengths which can be transmitted through the top plate, it is possible to reduce influences of infrared rays radiated from the top plate. Accordingly, with the induction heating apparatus in the thirteenth aspect of the present invention, it is possible to improve the accuracy of the detection of the temperature of the object to be heated. This can improve the cooking performance of an induction heating cooker, for example.

In a fourteenth aspect of the present invention, in the induction heating apparatus in any one of the first to seventh aspects, the infrared-ray detection portion may be adapted to have sensitivity to temperatures of 100° C. or less. In the induction heating apparatus having the aforementioned structure in the fourteenth aspect of the present invention, the infrared-ray detection portion may raise its temperature and may raise its temperature up to about 100° C. at the maximum, by being subjected to heat from the cooking container as an object to be heated, for example, the top plate, the heating coil, and the like. In such cases, in the present invention, the infrared-ray detection portion is adapted to have sensitivity to temperatures equal to or lower than 100° C. and, thus, is enabled to detect the temperature of the object to be heated with higher accuracy, which is particularly effective.

In a fifteenth aspect of the present invention, in the induction heating apparatus in any one of the first to seventh aspects, the infrared-ray detection portion may have a maximum sensitivity wavelength in the range of 1.9 to 2.0 μm and, further, may be adapted to detect the temperature of the object to be heated when it is at a temperature equal to or higher than 60° C. In the induction heating apparatus having the aforementioned structure in the fifteenth aspect of the present invention, the infrared-ray detection portion is enabled to have sensitivity to infrared ray energy radiated from the object to be heated at about 60° C. Accordingly, with the present invention, in an induction heating cooker having functions which necessitate accurate temperature detection for cooking containers at lower temperatures, for example, it is possible to improve the accuracy of the temperature detection, thereby improving the cooking performance of the induction heating cooker.

In cases where the infrared-ray detection portion is adapted to have a maximum sensitivity wavelength in the range of 1.9 to 2.0 μm, the infrared-ray detection portion is capable of receiving only slight energy, out of infrared ray energy radiated from a blackbody at 60° C. Referring to FIG. 1 described above, the broken lines represent the infrared ray energy radiated from the blackbody at 60° C. and from the blackbody at 140° C., and there is represented, by hatching, the area of the energy which can be received by the infrared-ray detection portion having a maximum sensitivity wavelength in the range of 1.9 to 2.0 μm.

Further, resins such as polycarbonate resins and acrylic resins have properties of being reduced in light transmittance for wavelengths equal to or longer than 1.7 μm.

In the case of employing conventional infrared-ray detection means, infrared rays radiated from the object to be heated are attenuated by the top plate and further, are largely attenuated by the condenser lens in the infrared ray detection means. This has induced the problem that the temperature detection can not be performed with higher accuracy when the object to be heated is at lower temperatures, for example, temperatures equal to or lower than 100° C.

The induction heating apparatus having the structure in the fifteenth aspect of the present invention is adapted to efficiently detect infrared rays radiated from the object to be heated and further, is enabled to minimize the attenuation by employing a Fresnel lens as the condenser lens and therefore, is capable of detecting the temperature of the object to be heated with high accuracy at a lower temperature. This can improve the cooking performance of an induction heating cooker, for example.

In a sixteenth aspect of the present invention, in the induction heating apparatus in any one of the aforementioned first to seventh aspects, the infrared-ray detection portion may have a maximum sensitivity wavelength in the range of 1.5 to 1.6 μm and further, may be adapted to detect the temperature of the object to be heated when it is at a temperature equal to or higher than 140° C.

As illustrated in FIG. 1 described above, in the case where the infrared-ray detection portion is adapted to have a maximum sensitivity wavelength in the range of 1.5 to 1.6 μm, the infrared-ray detection portion is capable of receiving only slight energy, out of infrared ray energy radiated from the blackbody at 140° C.

The induction heating apparatus having the aforementioned structure in the sixteenth aspect of the present invention is adapted to efficiently detect infrared rays radiated from the object to be heated and particularly, is enabled to minimize the attenuation by employing a Fresnel lens as the condenser lens and, therefore, is capable of detecting the temperature of the object to be heated with high accuracy. This can improve the cooking performance of an induction heating cooker, for example.

In a seventeenth aspect of the present invention, in the induction heating apparatus in any one of the first to seventh aspects, the infrared-ray detection portion may be adapted such that an infrared ray radiated from the object to be heated is incident to the infrared-ray detection portion, further the incident infrared ray is condensed by a Fresnel lens and, further, a detection signal is outputted from the infrared-ray reception portion, and the Fresnel lens includes a reflection reducing portion for reducing reflection of an infrared ray. The induction heating apparatus having the aforementioned structure in the seventeenth aspect of the present invention is enabled to minimize the reflection at the surface of the Fresnel lens and, therefore, is capable of detecting the temperature of the object to be heated with high accuracy. This can improve the cooking performance of an induction heating cooker, for example.

Advantageous Effects of the Invention

According to the present invention, it is possible to provide an induction heating apparatus which is capable of detecting the temperature of an object to be heated with high accuracy through infrared-ray detection means and thus, is capable of certainly heating the object to be heated in desired states.

DETAILED DESCRIPTION OF THE PREFERRED EMBODIMENTS

Hereinafter, with reference to the accompanying drawings, induction heating cookers will be described, as embodiments of an induction heating apparatus according to the present invention. Further, the induction heating apparatus according to the present invention is not limited to structures which will be described in the following embodiments and is intended to include induction heating apparatuses structured based on technical concepts equivalent to the technical concepts which will be described in the following embodiments and based on technical common senses in the present technical field.

First Embodiment

Figure 4:
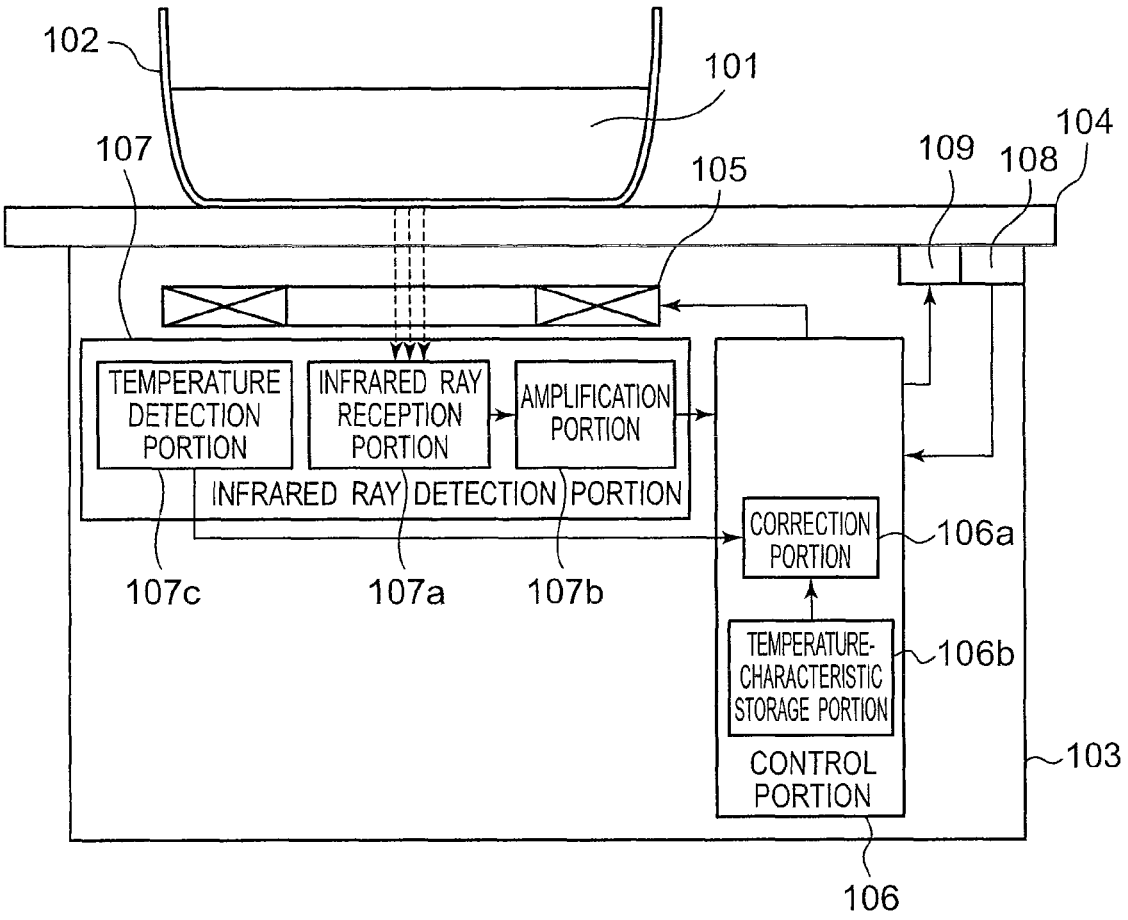
FIG. 4 is a block diagram schematically illustrating the structure of an induction heating cooker according to a first embodiment of the present invention.

FIG. 4 is a block diagram schematically illustrating the structure of an induction heating cooker according to a first embodiment of the present invention.

Referring to FIG. 4, the induction heating cooker according to the first embodiment is provided with a top plate 104 for placing a cooking container 102 thereon, on an upper portion of an outer case 103 which forms a lower-portion external appearance thereof, thereby forming the entire external appearance. Inside the outer case 103, there are provided a heating coil 105 for generating an induction magnetic field for heating the cooking container 102, a control portion 106 adapted to control a high-frequency electric current applied to the heating coil 105 for heating the cooking container 102, and an infrared-ray detection portion 107 which is adapted to detect infrared rays radiated from the cooking container 102 through the top plate 104 according to the temperature and to output infrared-ray detection signals according to the detected infrared ray energy. Further, beneath an end portion of the top plate 104, there are provided an input portion 108 adapted to receive user's inputs, and a notification portion 109 adapted to generate notifications of various information to the user. Further, in the induction heating cooker according to the first embodiment, a pan is employed, as the cooking container 102 for housing an object 101 to be cooked, which is an object to be heated.

The infrared-ray detection portion 107 includes: an infrared-ray reception portion 107*a* which is adapted to receive infrared rays, to convert the infrared rays into an electric-current signal and to output the signal as a detection signal; an amplification portion 107*b* which is adapted to amplify the electric-current signal outputted from the infrared-ray reception portion 107*a* and to output the signal as an infrared-ray detection signal; and a temperature detection portion 107*c* adapted to detect the temperature of the infrared-ray reception portion 107*a* itself.

The control portion 106 includes a correction portion 106*a* and a temperature-characteristic storage portion 106*b*. The correction portion 106*a* is adapted to calculate an amount of correction for canceling a negative signal (a reverse electric current) in the infrared-detection signal, based on the temperature of the infrared-ray detection portion 107, particularly the temperature of the infrared-ray reception portion 107*a*, which has been detected by the temperature detection portion 107*c*, and based on information from the temperature-characteristic storage portion 106. Further, the correction portion 106*a* is adapted to correct the infrared-ray detection signal outputted from the infrared-ray detection portion 107. The temperature-characteristic storage portion 106*b* stores negative-signal information indicative of the relationship between the temperature of the infrared-ray detection portion 107 and the negative signal.

In the induction heating cooker according to the first embodiment, the outer case 103 is constituted by a metal case, and the top plate 104 is formed from a heat-resistant glass made of a crystallized glass plate. Further, the heat-resistant glass employed in the first embodiment is one having the trade name "Neoceram N-0". The control portion 106 is constituted by a microcomputer. The infrared-ray reception portion 107*a* in the infrared-ray detection portion 107 is constituted by a photo diode, which is a quantum-type infrared-ray sensor. The amplification portion 107*b* is constituted by an operational amplifier, and the temperature detection portion 107*c* is constituted by a thermistor.

The input portion 108, which is adapted to receive user's inputs, is provided on the back surface of the top plate and is constituted by a capacitance-type switch. The notification portion 109, which is adapted to generate notifications of various information to the user, is constituted by an LCD (Liquid Crystal Display).

With the aforementioned structure, it is possible to easily realize the induction heating cooker according to the first embodiment.

Figure 5:
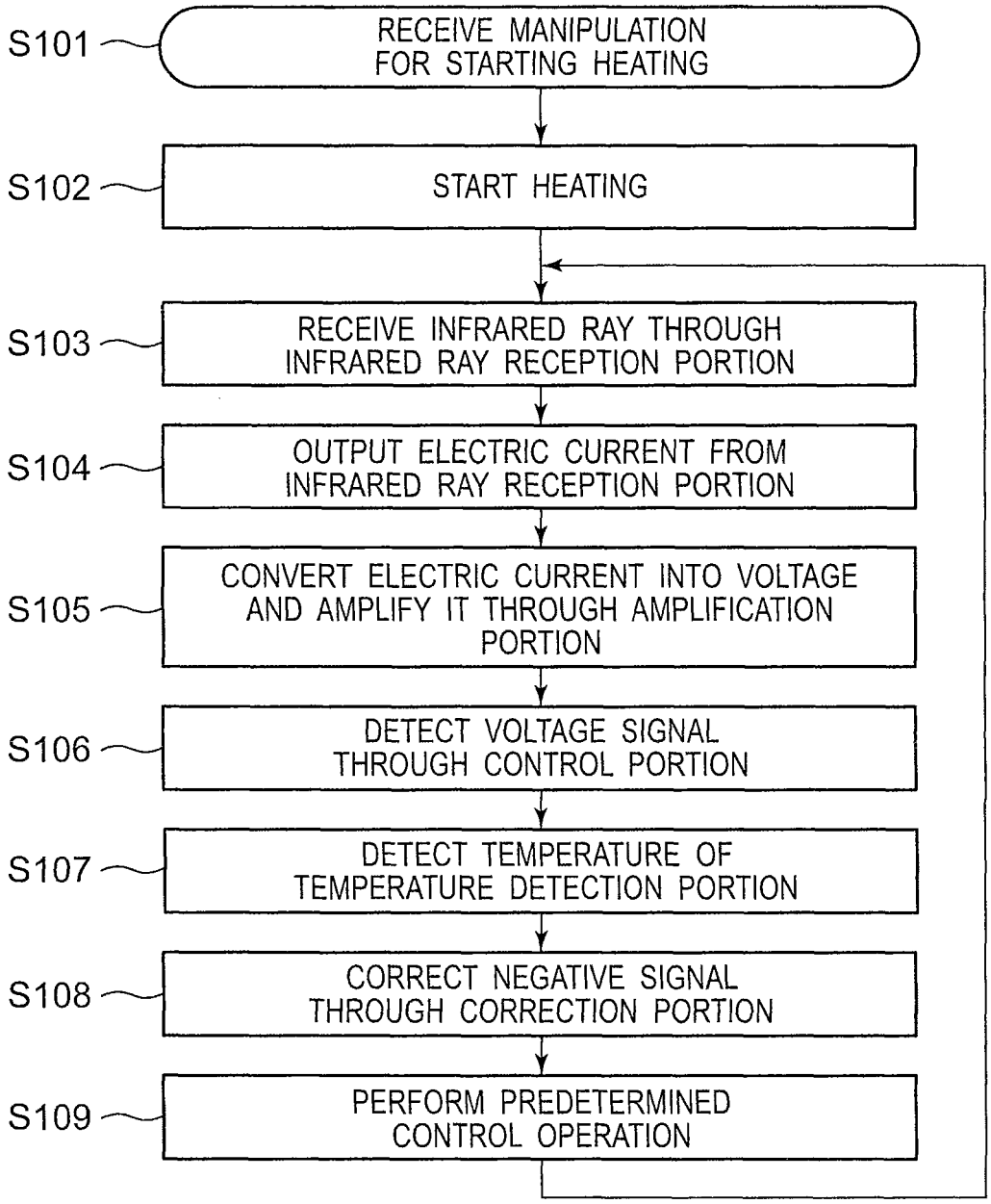
FIG. 5 is a flowchart illustrating operations of the induction heating cooker according to the first embodiment.

Next, there will be described the induction heating cooker having the aforementioned structure according to the first embodiment of the present invention, with respect to operations thereof. FIG. 5 is a flowchart illustrating operations of the induction heating cooker according to the first embodiment.

At first, the user selects a cooking menu and then, performs a manipulation for starting heating, through the input portion 108. On receiving a signal for starting heating from the input portion 108 (S101), the control portion 106 operates a high-frequency inverter (not illustrated) for applying a high-frequency electric current to the heating coil 105, thereby starting an operation for heating the cooking container 102 (S102).

The cooking container 102 being heated by the heating coil 105 radiates infrared rays according to the temperature of the cooking container 102 itself. Infrared rays radiated from the cooking container 102 are reflected or absorbed by the top plate 104, and only infrared rays coincident to light transmission characteristics of the top plate 104 are transmitted therethrough.

The infrared-ray reception portion 107*a* receives infrared rays transmitted through the top plate 104 (S103). The infrared-ray reception portion 107*a* outputs, as a detection signal, an electric-current signal proportional to the infrared-ray energy of infrared rays coincident to the sensitivity wavelengths of the infrared-ray reception portion 107*a*, out of the received infrared rays (S104). The amplification portion 107*b* is adapted to perform current-to-voltage conversion on the electric-current signal (the detection signal) from the infrared-ray reception portion 107*a* and to amplify it (S105).

In the first embodiment, the infrared-ray reception portion 107*a* is constituted by a photo diode, and the amplification portion 107*b* is constituted by an operational amplifier. Therefore, there is the following relationship among the photocurrent output Ish (the infrared-ray detection signal) outputted from the photo diode, the reverse electric current If (the negative signal) outputted when the temperature of the infrared-ray detection portion 107 (the infrared-ray reception portion 107*a*) is equal to or higher than the temperatures to be detected by the infrared-ray detection portion 107, and the output Vo of the operational amplifier.

$$Vo=-(Ish+If)\times Rf\pm Vos\times(1+Rf/Rsh) \quad (1)$$

In Formula (1), "Rf" is the feedback resistance which determines the amplification factor of the operational amplifier, and "Vos" is the input offset voltage of the operational amplifier. Accordingly, "(Ish×Rf)" is the infrared-ray real signal indicative of the infrared rays to be detected, and "(If ×Rf)" is the negative signal indicative of the amount of correction to be made. Further, "Vos×(1+Rf/Rsh)" is the amplified input offset voltage. "Rsh" represents the parallel resistance in the photo diode.

In the aforementioned formula (1), "(Ish×Rf)" (the infrared-ray real signal) is a signal component to be inherently detected, in the infrared-ray detection signal, while "(If ×Rf)" (the negative signal) and "Vos×(1+Rf/Rsh)" (the amplified input offset voltage signal) are noise components. Conventional induction heating cookers have made corrections for coping with such amplified input offset voltages, and therefore, corrections for coping with the infrared-ray real signal and the negative signal will be mainly described hereinafter.

The infrared-ray detection portion 107 raises its temperature by being subjected to heat from the cooking container 102, the top plate 104, the heating coil 105 and the like. If the temperature of the photo diode, which is the infrared-ray reception portion 107*a* in the infrared-ray detection portion 107, is raised as described above, this reduces the parallel resistance Rsh in the amplification portion 107*b*, thereby increasing the amplification factor for the input offset voltage Vos in the operational amplifier. As a result, the amplification portion 107*b* outputs an infrared-ray detection signal having the amplified input offset voltage Vos superimposed therein.

The voltage signal which is the infrared-ray detection signal outputted from the amplification portion 107*b* is detected by the control portion 106 (S106).

The control portion 106 operates the correction portion 106*a* for causing the correction portion 106*a* to acquire temperature information indicative of the temperature of the photo diode, which is the infrared-ray reception means 107*a*, from the temperature detection portion 107*c* (S107).

Figure 1:
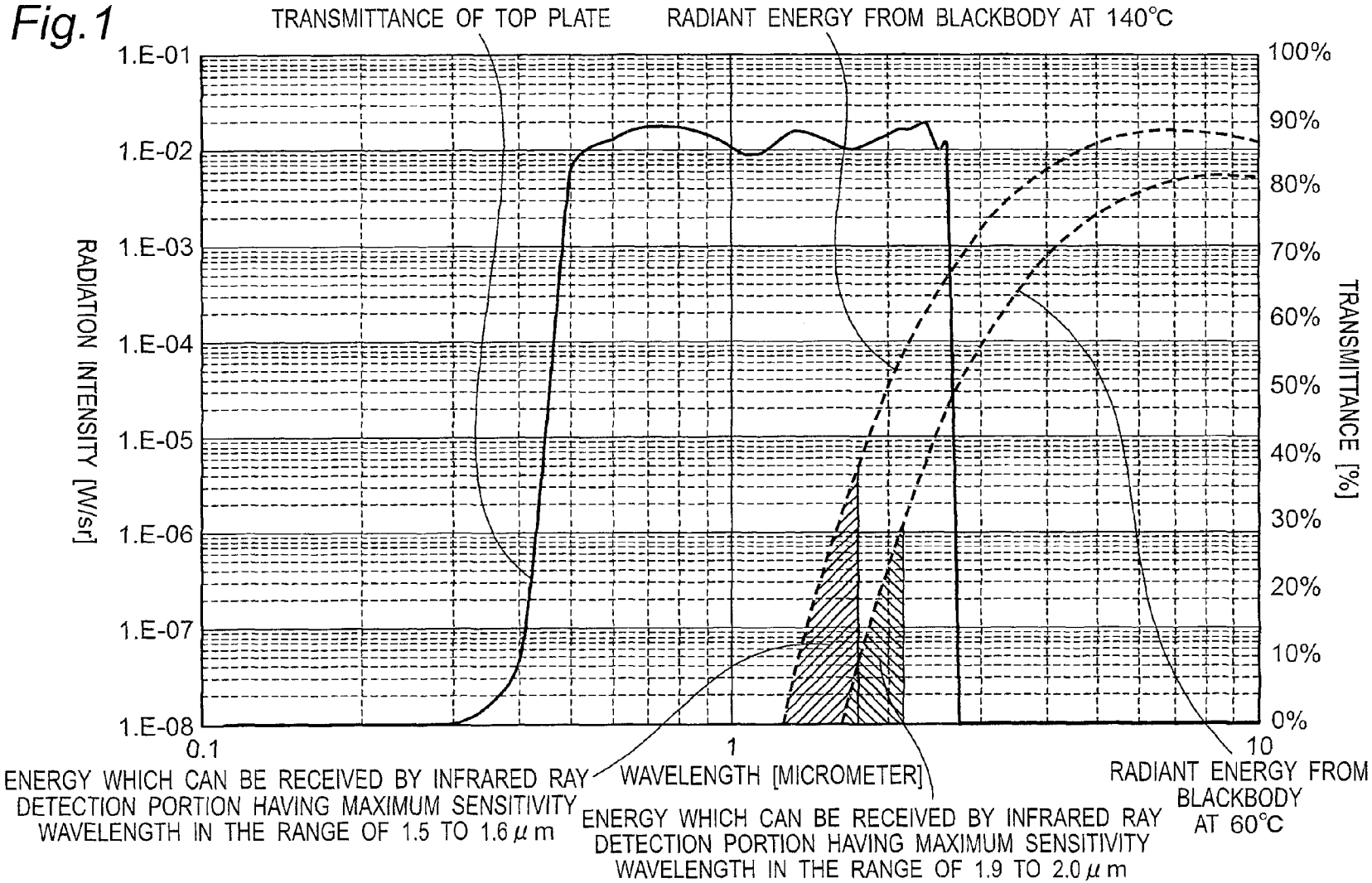
FIG. 1 is a graph illustrating a characteristic curve of light transmittance of a top plate and, further, illustrating the radiant energy from blackbodies at certain temperatures, and the energy which can be received by infrared-ray detection portions having certain maximum sensitivity wavelengths.
Figure 2:
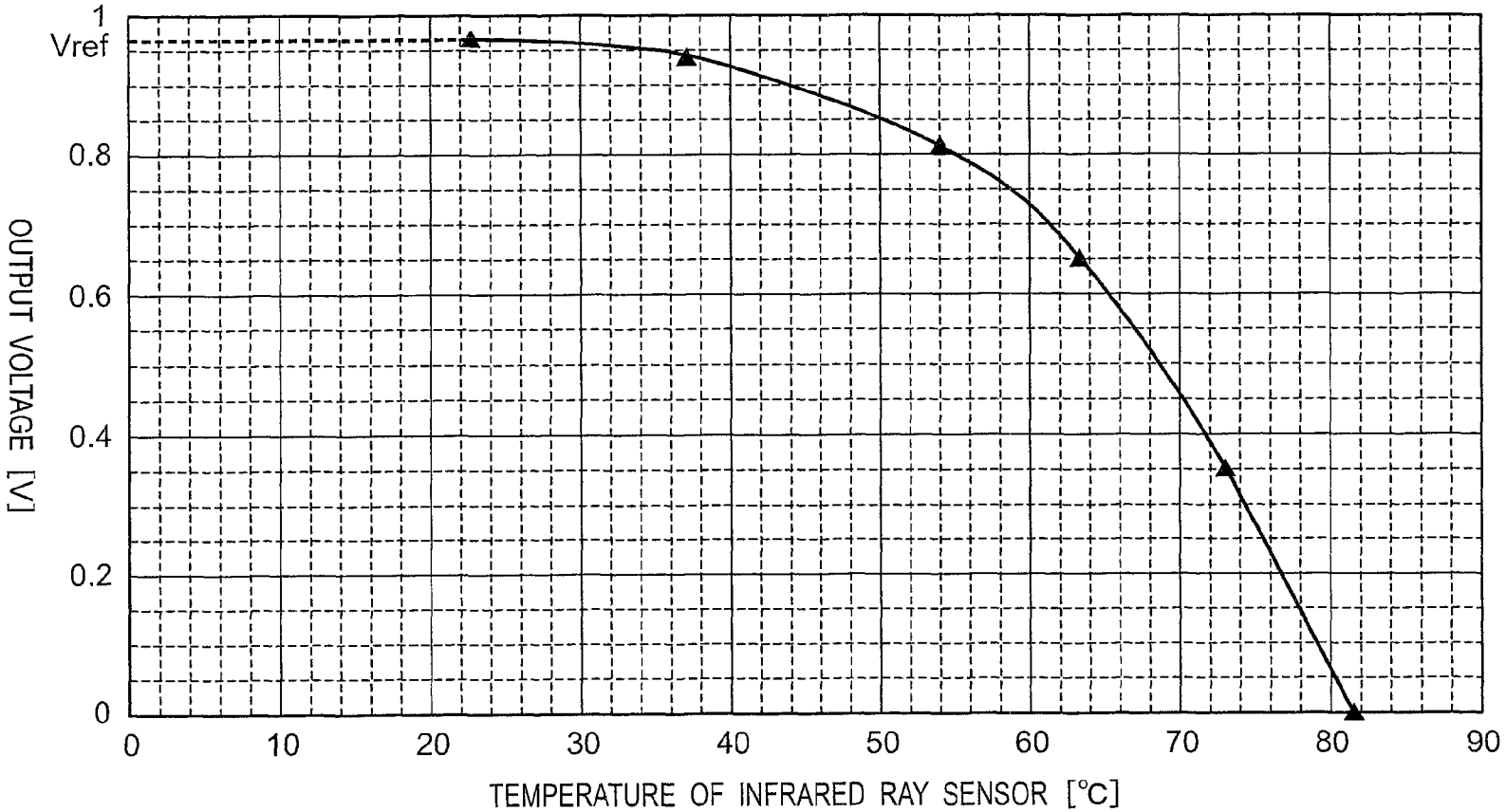
FIG. 2 is a graph illustrating an example of a negative signal outputted from an infrared ray sensor.
Figure 3:
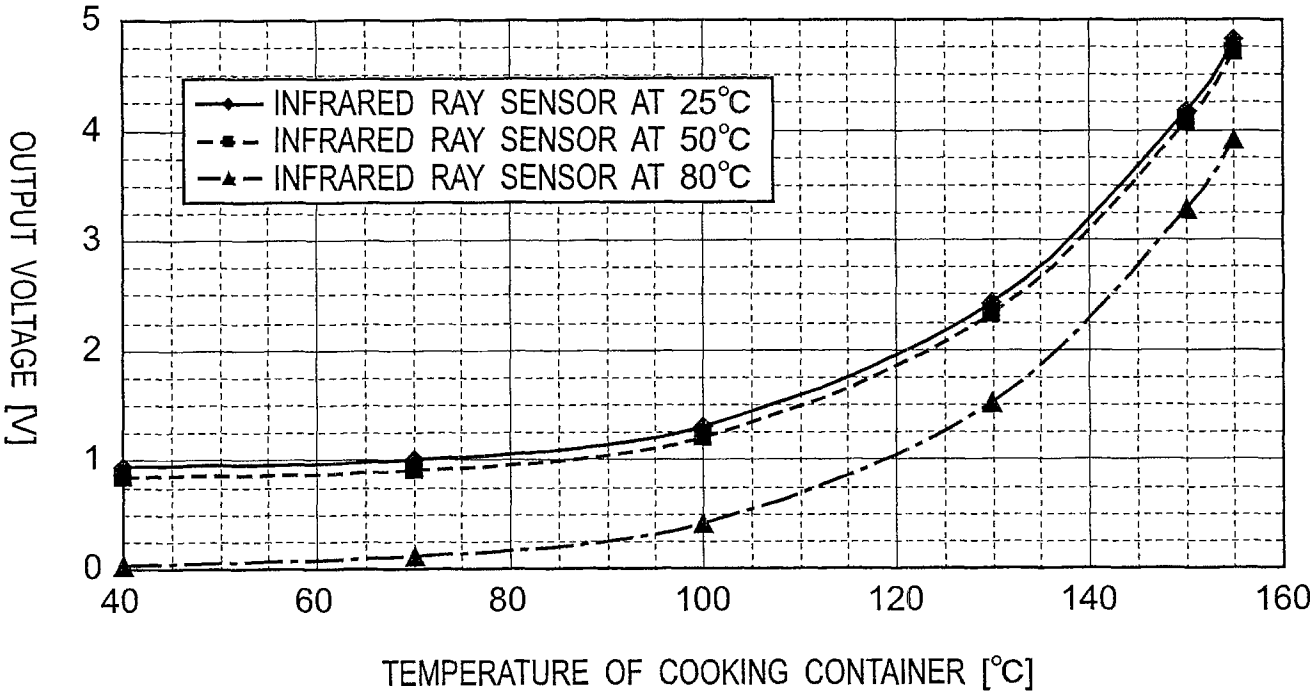
FIG. 3 is a graph illustrating a characteristic curve of in the case where the temperature of a cooking container is detected when the infrared ray sensor is at a certain temperature.

Based on the acquired temperature information, the correction portion 106*a* calculates the reverse electric current as the negative signal. In this case, the temperature-characteristic storage portion 106*b* has preliminarily stored negative-signal information indicative of the correlation between the temperature of the infrared-ray detection portion 107 and the negative signal. For example, the temperature-characteristic storage portion 106*b* has preliminarily stored, in the form of a table, negative-signal information indicative of the relationship between the temperature of the infrared-ray sensor (the infrared-ray detection portion) and the output voltage therefrom, as represented in FIG. 2. The correction portion 106*a* calculates the reverse electric current as the negative signal, by making a reference to the table having been stored in the temperature-characteristic storage portion 106*b*, based on the acquired temperature information. Further, in S0108, the infrared-ray real signal is calculated by canceling the calculated negative signal in the voltage signal (the infrared-ray detection signal) outputted from the amplification portion 107*b*, and by making a correction for coping with the input offset voltage signal.

The control portion 106 performs predetermined control for the selected cooking menu, based on the calculated infrared-ray real signal (S109).

Also, when the temperature information acquired in S107 indicates that the temperature of the photo diode as the infrared-ray reception portion 107*a* is lower than the temperatures to be detected by the infrared-ray detection portion 107 or is equal to or lower than a predetermined temperature out of the temperatures to be detected thereby, such as equal to or lower than 40° C., for example, it is possible to determine that the negative signal exerts less influences on the infrared-ray detection signal, and thus, it is possible to omit the correction operations by the correction portion 106*a* in S107 to S108. By adapting the correction portion 106*a* such that it performs no correction operation under certain conditions, it is possible to increase the processing speed in the induction heating cooker.

Also, the temperature-characteristic storage portion 106*b* can preliminarily store a calculation formula for calculating the negative signal from the temperature of the infrared-ray reception portion 107*a* (the photo diode), and further, the correction portion 106*a* can be caused to calculate the negative signal based on the calculation formula in S107, which can also offer the same effects.

Also, it is possible to superimpose a constant reference voltage on the detection signal outputted from the infrared-ray reception portion 107*a*. By superimposing such a constant reference voltage thereon, it is possible to prevent the voltage signal outputted from the infrared-ray detection portion 107 from varying around 0V at the time of the occurrence of the negative signal, which enables certainly detecting the electric current signal outputted from the infrared-ray reception portion 107*a*.

Further, although, in the aforementioned description of the first embodiment, the correction of the amplified input offset voltage has not been described, the input offset voltage is corrected, similarly, based on a table, a calculation formula or the like which has been preliminarily set, regarding the infrared-ray detection signal outputted from the infrared-ray detection portion 107, so that the infrared-ray real signal is calculated with higher accuracy. Thus, with the induction heating cooker according to the first embodiment, the negative signal and the amplified input offset voltage are corrected, thereby improving the accuracy of the detected temperature of the cooking container 102. As a matter of course, it is also possible to eliminate only influences of the reverse electric current as the negative signal, depending on the specifications.

Although the induction heating cooker according to the first embodiment has been described with respect to an example where a photo diode, which is a quantum-type infrared ray sensor, is employed as the infrared-ray reception portion 107*a*, it is also possible to employ infrared-ray reception means other than those of quantum types. In cases of infrared-ray reception means other than those of quantum types, similarly, if the temperature of the infrared-ray detection portion is raised to be equal to or higher than the temperatures to be detected by the infrared-ray detection portion, it outputs a negative signal with the reverse polarity from that of the output signal, which is superimposed on the infrared-ray detection signal, similarly to in the case of quantum type infrared-ray reception means. Accordingly, in the case of infrared-ray reception means other than those of quantum types, it is possible to similarly correct the negative signal, thereby offering the same effects.

Further, in the induction heating cooker according to the first embodiment, it is particularly preferable that the infrared-ray reception portion 107*a* be structured to be sensitive to temperatures equal to or lower than 100° C. The infrared-ray reception portion 107*a* raises its temperature by being subjected to heat from the cooking container 102, the top plate 104, the heating coil 105 and the like. Depending on the structure of the induction heating cooker, the infrared-ray reception portion 107*a* may raise its temperature up to 100° C. at the maximum. Therefore, in the first embodiment, it is particularly effective to structure the infrared-ray reception portion 107*a* such that it is sensitive to temperatures equal to or lower than 100° C.

Also, it is possible to structure the infrared-ray reception portion 107*a* such that it is sensitive to higher temperatures which are equal to or higher than 150° C. However, in this case, the present invention can less exert its effects, since the infrared-ray reception portion 107*a* may rarely raise its temperature up to temperatures equal to or higher than 150° C., in view of its structure.

Further, in the induction heating cooker according to the first embodiment, the infrared-ray reception portion 107*a* is adapted to have a maximum sensitivity wavelength in the range of 1.9 to 2.0 μm. With this structure, the infrared-ray reception portion 107*a* is enabled to certainly have sensitivity to infrared ray energy radiated from the cooking container 102 being at about 60° C. Accordingly, with the structure of the induction heating cooker according to the first embodiment, in the case where there is a need for an accurately-detected temperature of the cooking container 102 being at a lower temperature equal to or lower than 100° C., for example, it is possible to improve the accuracy of the detected temperature, thereby dramatically improving the cooking performance of the induction heating cooker.

Second Embodiment

Figure 6:
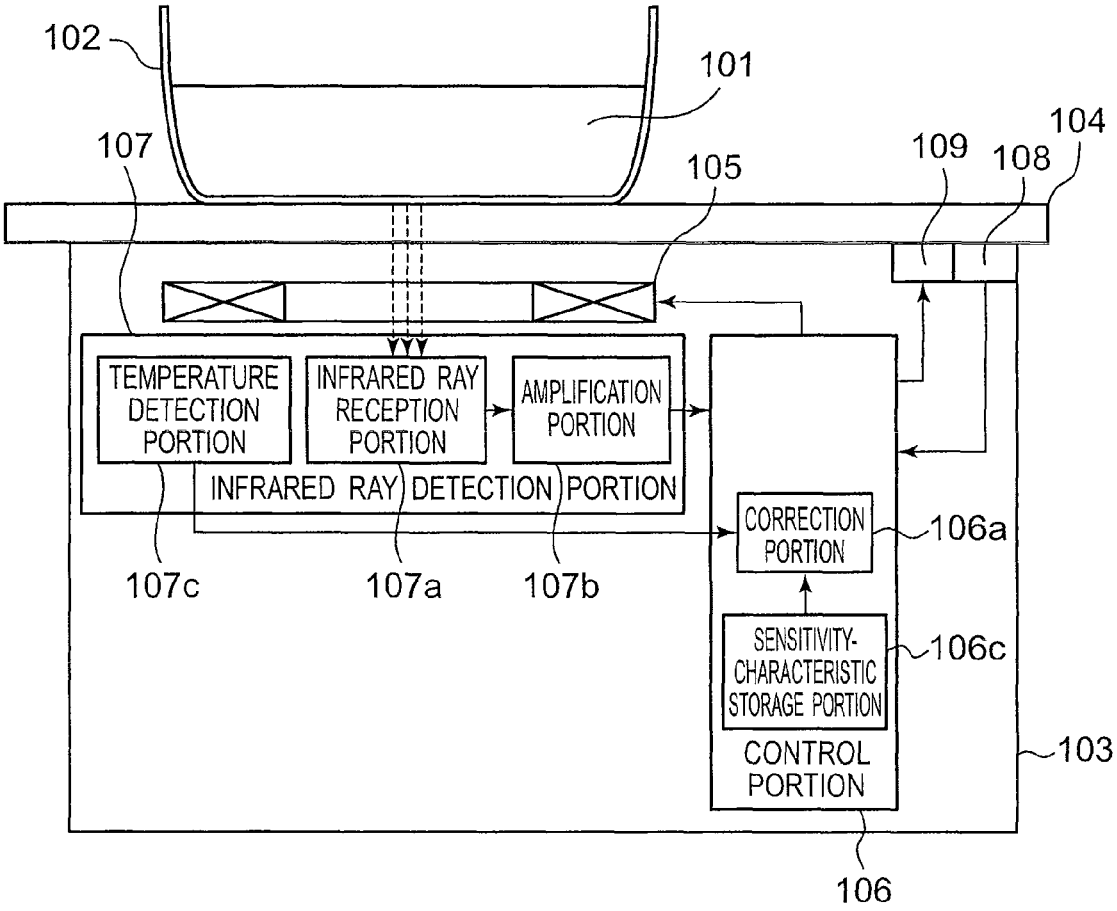
FIG. 6 is a block diagram schematically illustrating the structure of an induction heating cooker according to a second embodiment of the present invention.

FIG. 6 is a block diagram schematically illustrating the structure of an induction heating cooker according to a second embodiment of the present invention.

The induction heating cooker according to the second embodiment illustrated in FIG. 6 is different from the induction heating cooker according to the first embodiment, in that a control portion 106 includes a sensitivity-characteristic storage portion 106*c* which stores a cutoff wavelength of an infrared-ray reception portion 107*a*, instead of the temperature-characteristic storage portion 106*b*. It is to be noted that the induction heating cooker according to the second embodiment is the same as the induction heating cooker according to the first embodiment, in terms of the other points, and therefore, will be mainly described with respect to the different points. In the following description about the second embodiment, the components having the same functions and structures as those of the induction heating cooker 1 according to the first embodiment will be designated by the same reference characters and will not be described in detail, and the description about the first embodiment will be substituted therefor.

Figure 7:
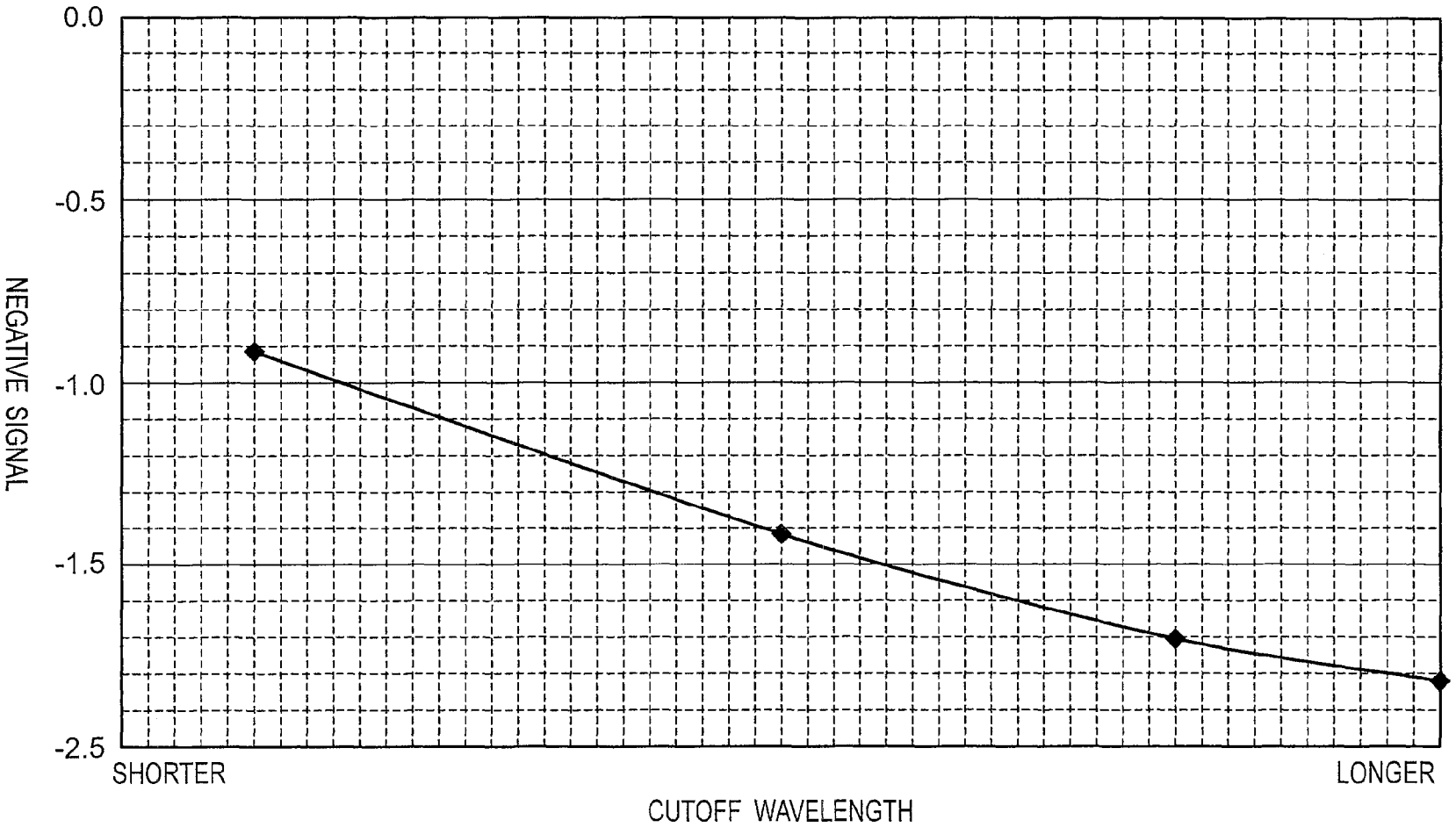
FIG. 7 is a graph illustrating the relationship between a negative signal and a cutoff wavelength in an infrared-ray reception portion.

FIG. 7 is a graph illustrating the relationship between a negative signal and the cutoff wavelength of a photo diode as the infrared-ray reception portion 107*a*. In this case, the cutoff wavelength refers to a wavelength to which the photo diode having sensitivity to a certain wavelength range has significantly-reduced sensitivity, and the photo diode outputs about zero at the cutoff wavelength.

There is a correlation between the magnitude of the negative signal (the reverse electric current signal) and the cutoff wavelength in the infrared-ray reception portion 107*a* (the photo diode), and the infrared-ray reception portion 107*a* (the photo diode) has such a characteristic that the negative signal is increased as the wavelength is increased. From this fact, it can be seen that it is possible to estimate the magnitude of the negative signal, based on the cutoff wavelength of the infrared-ray reception portion 107*a*.

Accordingly, by preliminarily grasping the correlation between the cutoff wavelength and the negative signal, it is possible to detect the magnitude of the negative signal based on the cutoff wavelength of the infrared-ray reception portion 107*a*, and it is possible to correct the infrared-ray detection signal.

In the second embodiment, the sensitivity-characteristic storage portion 106*c* has preliminarily stored negative-signal information about the cutoff wavelength of the infrared-ray reception portion 107*a*. The correction portion 106*a* acquires the reverse electric current which is the negative signal, based on the negative-signal information about the cutoff wavelength, which has been stored in the sensitivity-characteristic storage portion 106*c*, if the correction portion 106*a* detects, from temperature information from a temperature detection portion 107*c*, that the temperature of the infrared-ray reception portion 107*a* has come to be a temperature to be detected.

Further, the correction portion 106*a* calculates an infrared-ray real signal indicative of the temperature of the cooking container, by canceling the negative signal in the infrared-ray detection signal which is the voltage signal outputted from an amplification portion 107*b*.

Infrared-ray reception portions 107*a* fabricated from the same wafer have cutoff wavelengths which are not largely different from one another. Therefore, the cutoff wavelength is determined for each wafer, and the cutoff-wavelength information about each wafer is stored as negative-signal information in the sensitivity-characteristic storage portion 106*c*. Accordingly, based on acquired temperature information and the negative-signal information about the cutoff wavelength stored in the sensitivity-characteristic storage portion 106*c*, the correction portion 106*a* calculates the infrared-ray real signal, by making corrections to the voltage signal (the infrared-ray detection signal) outputted from the amplification portion 107*b*, for coping with the negative signal and for coping with the input offset voltage signal, if necessary. As described above, with the structure according to the second embodiment, it is possible to make corrections to the infrared-ray detection signal for coping with the negative signal and the like, thereby easily and certainly acquiring the infrared-ray real signal with higher accuracy.

Further, the induction heating cooker according to the second embodiment can be also structured such that the sensitivity-characteristic storage portion 106*c* stores a spectral-sensitivity characteristic of the infrared-ray reception portion 107*a*, and the infrared-ray detection signal is corrected based on the spectral-sensitivity characteristic, which can also offer the same effects. Here, the spectral-sensitivity characteristic refers to a sensitivity characteristic with respect to light wavelengths and, thus, refers to a characteristic of signals outputted from the infrared-ray reception portion 107*a* in the infrared-ray detection portion 107.

Third Embodiment

Figure 8:
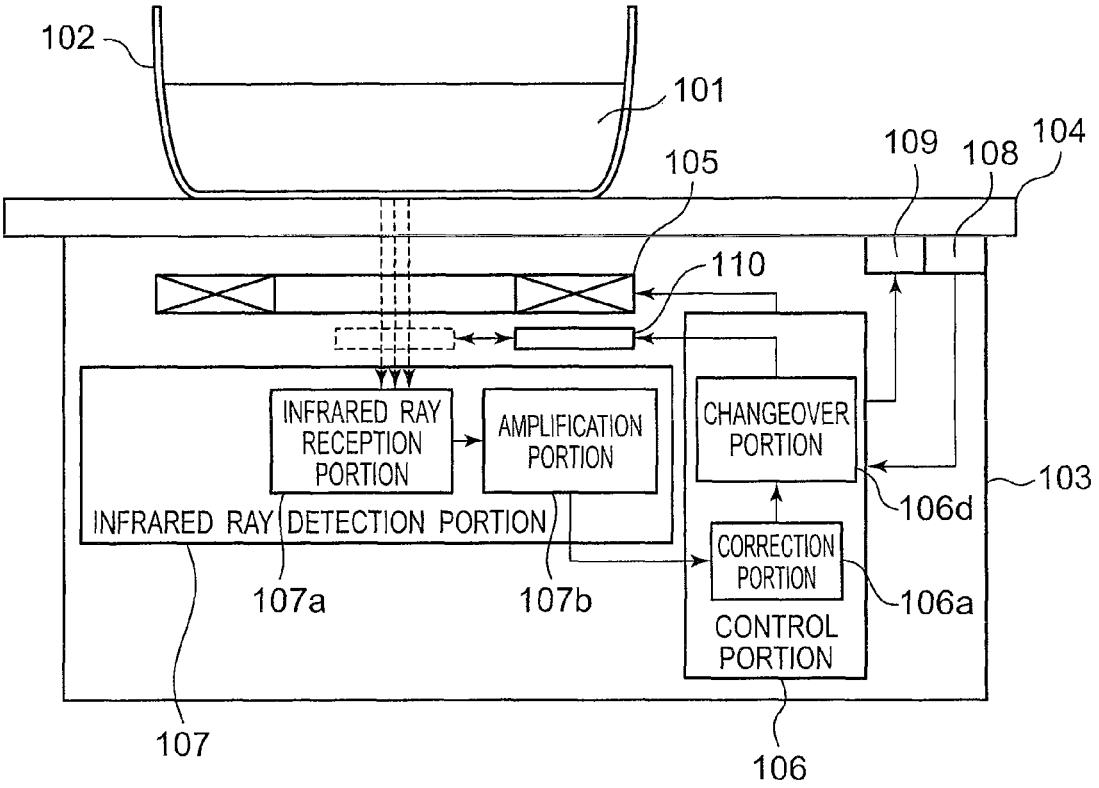
FIG. 8 is a block diagram schematically illustrating the structure of an induction heating cooker according to a third embodiment of the present invention.

FIG. 8 is a block diagram schematically illustrating the structure of an induction heating cooker according to a third embodiment of the present invention.

The induction heating cooker according to the third embodiment illustrated in FIG. 8 is different from the induction heating cooker according to the first embodiment, in that a light interception portion 110 is provided, and an infrared-ray detection portion 107 is not provided with a temperature detection portion 107*c*. The induction heating cooker according to the third embodiment is the same as the induction heating cooker according to the first embodiment, in terms of the other points. In the following description about the third embodiment, the components having the same functions and structures as those of the induction heating cooker 1 according to the first embodiment will be designated by the same reference characters and will not be described.

Referring to FIG. 8, the induction heating cooker according to the third embodiment includes an outer case 103, a top plate 104, a heating coil 105, a control portion 106, an infrared-ray detection portion 107, an input portion 108, and a notification portion 108, similarly to the induction heating cooker according to the first embodiment. It is to be noted that in the induction heating cooker according to the third embodiment, a pan is employed, as a cooking container 102 as an object to be heated on the top plate 104.

The induction heating cooker according to the third embodiment is provided with the light interception portion 110 for prohibiting infrared rays radiated from the cooking container 102 from being received by the infrared-ray reception portion 107*a*.

Further, in the induction heating cooker according to the third embodiment, the control portion 106 includes: a changeover portion 106*d* adapted to change over between reception of infrared rays radiated from the cooking container 102 by the infrared-ray reception portion 107*a* and interception of infrared rays from the infrared-ray reception portion 107*a*; and a correction portion 106*a* adapted to correct the infrared-ray detection signal using detection signals resulted from changeover operations by the changeover portion 106*d*. As described above, a negative signal with the reverse polarity from that of the infrared-ray detection signal is superimposed on the infrared-ray detection signal outputted from the infrared-ray detection portion 107. Particularly, if the temperature of the infrared-ray detection portion 107 is raised to be equal to or higher than temperatures to be detected by the infrared-ray detection portion 107, such a negative signal which exerts larger influences on the infrared-ray detection signal is superimposed thereon.

In the induction heating cooker according to the third embodiment, the correction portion 106*a* performs corrections for canceling the negative signal in the infrared-ray detection signal, based on differences in detection signals resulted from changeover operations by the changeover portion 106*c*.

Further, the infrared-ray detection portion 107 includes: an infrared-ray reception portion 107*a* which is adapted to receive infrared rays from the cooking container 102 and to convert the infrared rays into an electric current signal (a detection signal); and an amplification portion 107*b* which is adapted to amplify the electric current signal outputted from the infrared-ray reception portion 107*a*.

In the induction heating cooker according to the third embodiment, the outer case 103 is constituted by a metal case, and the top plate 104 is formed from a heat-resistant glass made of a crystallized glass plate having the trade name "Neoceram N-0", similarly to in the first embodiment. The control portion 106 is constituted by a microcomputer. The infrared-ray reception portion 107*a* in the infrared-ray detection portion 107 is constituted by a photo diode, which is a quantum-type infrared ray sensor. The amplification portion 107*b* is constituted by an operational amplifier. The light interception portion 110 for changing over between reception of infrared rays and interception of infrared rays, with respect to the infrared-ray reception portion 107*a*, is constituted by an optical chopper.

The input portion 108, which is adapted to receive user's inputs, is constituted by a capacitance-type switch. The notification portion 109, which is adapted to generate notification of various information to the user, is constituted by an LCD (Liquid Crystal Display). With the structure described above, it is possible to easily realize the induction heating cooker according to the third embodiment.

Next, there will be described the induction heating cooker having the aforementioned structure according to the third embodiment of the present invention, with respect to operations thereof.

At first, the user selects a cooking menu to perform a manipulation for starting heating, through the input portion 108. On receiving a signal for starting heating from the input portion 108, the control portion 106 operates a high-frequency inverter (not illustrated) for applying a high-frequency electric current to the heating coil 105, thereby starting an operation for heating the cooking container 102.

The cooking container 102 being heated by the heating coil 105 radiates infrared rays according to the temperature of the cooking container 102 itself. Infrared rays radiated from the cooking container 102 are reflected or absorbed by the top plate 104 to be attenuated. Out of infrared rays having been absorbed by the top plate 104 to be attenuated, only infrared rays coincident to light transmittance characteristics of the top plate 104 are transmitted therethrough.

The infrared-ray reception portion 107*a* outputs, as a detection signal, an electric-current signal proportional to the infrared-ray energy of infrared rays coincident to the sensitivity wavelengths of the infrared-ray reception portion 107*a*, out of the infrared rays having been transmitted through the top plate 104 and received thereby. The amplification portion 107*b* is adapted to perform current-to-voltage conversion on the electric-current signal from the infrared-ray reception portion 107*a* and to amplify the signal.

In the third embodiment, similarly to in the first embodiment, there is the following relationship among the photocurrent output Ish (the infrared-ray detection signal) outputted from the photo diode as the infrared-ray reception portion 107*a*, the reverse electric current If (the negative signal) outputted when the temperature of the infrared-ray detection portion 107 (the infrared-ray reception portion 107*a*) is equal to or higher than the temperatures to be detected by the infrared-ray detection portion 107, and the output Vo of the operational amplifier.

$$Vo=-(Ish+If)\times Rf\pm Vos\times(1+Rf/Rsh) \quad (2)$$

In Formula (2), "Rf" is the feedback resistance which determines the amplification factor of the operational amplifier, and "Vos" is the input offset voltage of the operational amplifier. Accordingly, "(Ish×Rf)" is the infrared-ray real signal indicative of infrared rays to be detected, and "(If×Rf)" is the negative signal indicative of the amount of correction to be made. Further, "Vos×(1+Rf/Rsh)" is the amplified input offset voltage. "Rsh" represents the parallel resistance in the photo diode.

In the Formula (2), "(Ish×Rf)" (the infrared-ray real signal) is a signal component to be inherently detected, in the infrared-ray real signal, while "(If ×Rf)" (the negative signal) and "Vos×(1+Rf/Rsh)" (the amplified input offset voltage signal) are noise components.

The infrared-ray detection portion 107 raises its temperature by being subjected to heat from the cooking container 102, the top plate 104, the heating coil 105 and the like. If the temperature of the photo diode, which is the infrared-ray reception portion 107*a* in the infrared-ray detection portion 107, is raised as described above, this reduces the parallel resistance Rsh in the amplification portion 107*b*, thereby increasing the amplification factor for the input offset voltage Vos in the operational amplifier. As a result, the amplification portion 107*b* outputs an infrared-ray detection signal having the amplified input offset voltage Vos superimposed therein.

The voltage signal which is the infrared-ray detection signal outputted from the amplification portion 107*b* is detected by the control portion 106.

Thereafter, the correction portion 106*a* causes the changeover portion 106*b* to perform a changeover operation, thereby driving the light interception portion 110. Since the light interception portion 110 is driven, infrared rays having been radiated from the cooking container 102 and transmitted through the top plate 104 are intercepted by the light interception portion 110, which prohibits the infrared-ray reception portion 107*a* from receiving infrared rays.

In the state where the infrared-ray reception portion 107*a* is prohibited from receiving light as described above, the infrared-ray reception portion 107*a* outputs no infrared-ray detection signal and outputs only the negative signal.

The correction portion 106*a* calculates the difference between the output of when the infrared-ray reception portion 107*a* receives infrared rays and the output of when it receives no infrared ray due to light interception by the light interception portion 110. The correction portion 106*a* calculates the infrared-ray real signal indicative of infrared rays radiated from the cooking container 102, by correcting the negative signal superimposed on the infrared-ray detection signal, based on the calculated output difference.

The control portion 106 performs predetermined control for the selected cooking menu, based on the calculated infrared-ray real signal.

Also, the induction heating cooker according to the third embodiment can be structured to determine that the negative signal exerts less influences on the infrared-ray detection signal and, thus, to omit the correction operations by the correction portion 106*a*, when the temperature of the infrared-ray reception portion 107*a* is lower than the temperatures to be detected by the infrared-ray detection portion 107 or is equal to or lower than a predetermined temperature out of the temperatures to be detected thereby, such as equal to or lower than 40° C., for example, as described in the aforementioned first embodiment.

The induction heating cooker according to the third embodiment can be also adapted to superimpose a constant reference voltage on the detection signal outputted from the infrared-ray reception portion 107*a*, as described in the first embodiment.

Further, although the induction heating cooker according to the third embodiment is adapted such that the changeover portion 106*c* drives the light interception portion 110 for changing over between interception of infrared rays and reception of infrared rays with respect to the infrared-ray reception portion 107*a*, the infrared-ray detection portion 107 itself can move for changing over between interception of infrared rays and reception of infrared rays, which can also offer the same effects.

In the induction heating cooker according to the third embodiment, similarly to in the induction heating cooker according to the first embodiment, it is also possible to employ infrared-ray reception means other than those of quantum types, as the infrared-ray reception portion 107*a*.

In the induction heating cooker having the aforementioned structure according to the third embodiment, similarly to in the first embodiment, it is particularly effective that the infrared-ray reception portion 107*a* is structured to be sensitive to temperatures equal to or lower than 100° C., which enables temperature detection with higher accuracy.

Further, in the induction heating cooker according to the third embodiment, the infrared-ray reception portion 107*a* is adapted to have a maximum sensitivity wavelength in the range of 1.9 to 2.0 μm. With this structure, the infrared-ray reception portion 107*a* is enabled to certainly have sensitivity to infrared ray energy radiated from the cooking container 102 being at about 60° C. Accordingly, with the structure of the induction heating cooker according to the third embodiment, in the case where there is a need for an accurately-detected temperature of the cooking container 102 being at a lower temperature equal to or lower than 100° C., for example, it is possible to improve the accuracy of the detected temperature, thereby dramatically improving the cooking performance of the induction heating cooker.

Fourth Embodiment

Figure 9:
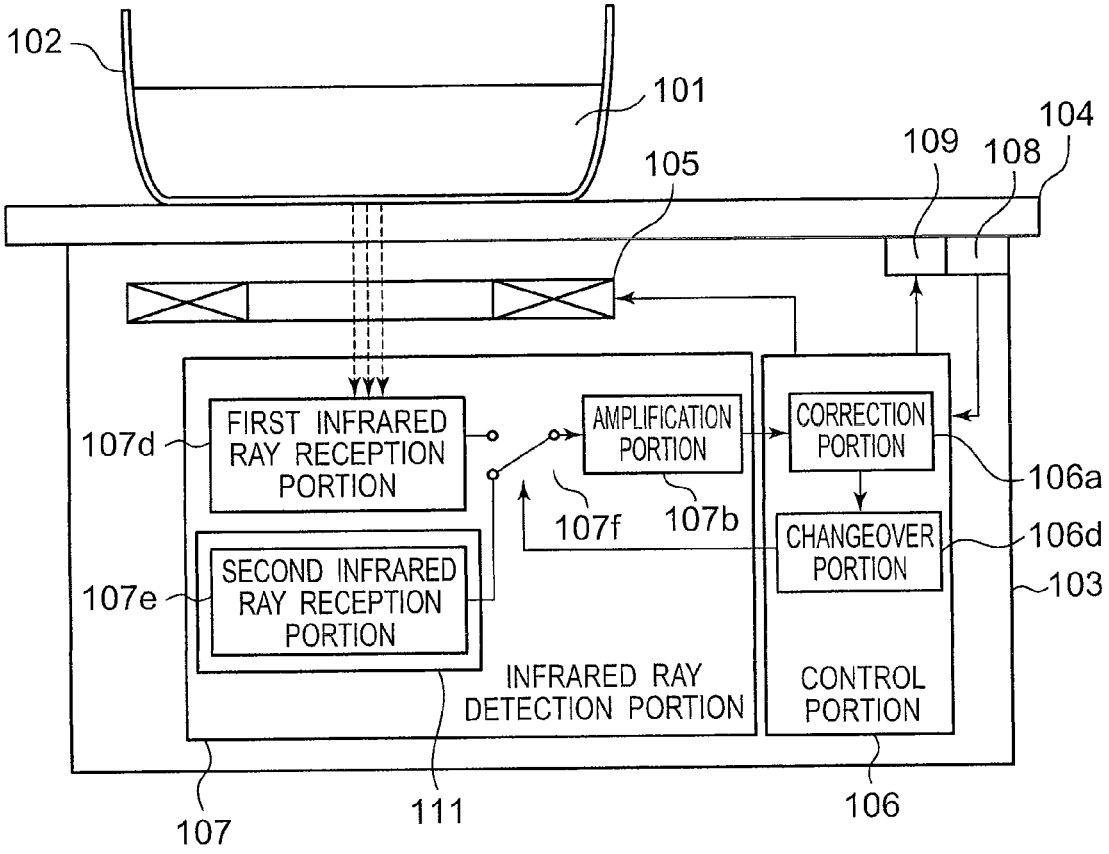
FIG. 9 is a block diagram schematically illustrating the structure of an induction heating cooker according to a fourth embodiment of the present invention.

FIG. 9 is a block diagram schematically illustrating the structure of an induction heating cooker according to a fourth embodiment of the present invention.

The induction heating cooker according to the fourth embodiment illustrated in FIG. 9 is different from the induction heating cooker according to the third embodiment, in that two infrared-ray reception portions 107*d* and 107*e* are provided and, one of them is housed in a light interception case 111, instead of providing the light interception portion 110.

As illustrated in FIG. 9, an infrared-ray detection portion 107 according to the fourth embodiment includes a first infrared-ray reception portion 107*d* which is adapted to detect infrared rays radiated from a cooking container 102 according to the temperature thereof and to output a signal according to the detected infrared ray energy, a second infrared-ray reception portion 107*e* which is provided near the first infrared-ray reception means 107*d* and is shielded by the light interception case 111 in such a way as to be prevented from receiving infrared rays, an amplification portion 107*b* which is adapted to amplify an electric current signal outputted from one of the first infrared-ray reception portion 107*d* and the second infrared-ray reception portion 107*e*, and a switch 107*f* adapted to change over between the infrared-ray reception portions (107*d* and 107*e*) to be subjected to the amplification by the amplification portion 107*b*.

The control portion 106 includes a changeover portion 106*d* adapted to control changeover operations by the switch 107*f*, and a correction portion 106*a* adapted to perform corrections based on the difference between the outputs from the first infrared-ray reception portion 107*d* and the second infrared-ray reception portion 107*e*.

In the induction heating cooker according to the fourth embodiment, the other structures are the same as those in the induction heating cooker according to the third embodiment illustrated in FIG. 8. Therefore, the components having the same functions and structures as those of the induction heating cooker according to the third embodiment will be described by being designated by the same reference characters.

Further, in the induction heating cooker according to the fourth embodiment, an analog switch is employed as the switch 107*f* in the infrared-ray detection portion 107. Here, the analog switch is adapted to perform changeover operations according to the state of signals inputted thereto. By using such an analog switch, it is possible to easily realize the structure according to the fourth embodiment.

Next, there will be described the correction portion 106*a* in the induction heating cooker having the aforementioned structure according to the fourth embodiment of the present invention, regarding operations thereof.

In the induction heating cooker according to the fourth embodiment, when a heating operation is started, at first, the correction portion 106*a* drives the changeover portion 106*d* for causing it to perform a changeover such that the output of the first infrared-ray reception portion 107*d* is detected.

When the first infrared-ray reception portion 107*d* receives infrared rays coincident to the sensitivity wavelengths of the first infrared-ray reception portion 107*d*, out of infrared rays transmitted through the top plate 104, the first infrared-ray reception portion 107*d* outputs an electric current signal (a detection signal) proportional to the received infrared ray energy, to the amplification portion 107*b*, through the switch 107*f*. The amplification portion 107*b* performs current-to-voltage conversion on the electric current signal inputted thereto, and amplifies and outputs the signal to the correction portion 106*a*. The correction portion 106*a* detects the amplified voltage signal (the infrared-ray detection signal) from the amplification portion 107*b*.

At this time, the infrared-ray detection signal detected by the correction portion 106*a* is a signal having a negative signal superimposed therein, and thus, is the sum of an infrared-ray real signal and the negative signal. Thereafter, after the elapse of a predetermined time period, the correction portion 106*a* drives the changeover portion 106*d* for causing it to change over the switch 107*f* such that the output of the second infrared-ray reception portion 107*e* is inputted to the amplification portion 107*b*. Accordingly, when the output of the second infrared-ray reception portion 107*e* is inputted to the amplification portion 107*b*, the output of the first infrared-ray reception portion 107*d* is intercepted, while only the negative signal from the second infrared-ray reception portion 107*e* is amplified by the amplification portion 107*b*, and the amplified negative signal is inputted to the correction portion 106*a*. Since the second infrared-ray reception portion 107*e* is housed within the interception case 111 such that it receives no infrared rays, as described above, the second infrared-ray reception portion 107*e* continuously outputs only the negative signal. Further, the second infrared-ray reception portion 107*e* is provided near the first infrared-ray reception means 107*d*, and they are placed in substantially the same temperature environment.

The correction portion 106*a* performs operating processing (canceling processing) on the negative signal outputted from the second infrared-ray reception portion 107*e*, regarding the infrared-ray detection signal having the negative signal superimposed therein, which has been outputted from the first infrared-ray reception portion 107*d*, in order to calculate the infrared-ray real signal indicative of actual infrared rays radiated from the cooking container 102. Namely, the correction portion 106*a* calculates the difference between the output of when the infrared-ray reception portions (107*d* and 107*e*) receive infrared rays radiated from the cooking container 102 and the output of when they do not receive infrared rays due to the light interception. Further, the correction portion 106*a* performs processing for canceling the negative signal in the infrared-ray detection signal to calculate the infrared-ray real signal indicative of the radiant energy which is actually radiated from the cooking container 102.

Fifth Embodiment

In the induction heating cookers according to the first to fourth embodiments, an infrared ray sensor is employed as the infrared ray detection portion. The infrared-ray sensor is provided with a lens made of a resin for condensing infrared rays, and is structured to detect infrared rays transmitted through the top plate made of a heat-resistant glass and through the lens in the infrared ray sensor, out of infrared rays radiated from the cooking container. The top plate and the lens have different light transmittance characteristics and, accordingly, infrared rays radiated from the cooking container are attenuated by the top plate and further, are attenuated by the lens. As described above, the induction heating cooker is adapted such that the infrared-ray sensor detects infrared rays having been attenuated by the top plate and the lens, which causes the infrared-ray sensor to receive less infrared ray energy, thereby inducing the problem of difficulty of accurately detecting the temperature of the cooking container, particularly, when it is at lower temperatures.

In order to cause the infrared-ray sensor to certainly detect infrared rays having been attenuated as described above, it is necessary to increase electric signals outputted from the infrared-ray reception device included in the infrared-ray sensor.

If the infrared-ray sensor is structured such that the infrared-ray reception device therein has an increased light-reception area, this certainly increases electric signals outputted from the infrared-ray reception device. However, if electric signals are increased as described above, this also increases dark electric currents which are output electric currents in dark states. This causes electric signals outputted from the infrared-ray reception device to contain such increased dark electric currents, which induces the problem of increases of errors in detection of the temperature of the cooking container by amounts corresponding to such dark electric currents.

Further, if the light-reception area is increased, this increases the cost of the infrared-ray reception device, thereby inducing the problem of expensiveness of the product.

If the infrared-ray sensor is replaced with one including an infrared-ray reception device having longer sensitivity wavelengths, this also increases electric signals outputted from the infrared-ray reception device. However, such an infrared-ray sensor having longer sensitivity wavelengths also has sensitivity to infrared rays radiated from objects being at lower temperatures. As a result, the infrared-ray sensor having such a structure is caused to receive infrared rays radiated from other objects than the cooking container to be subjected to detection, which induces the problem that electric signals outputted from the infrared-ray reception device contain external disturbances.

Further, if the infrared-ray reception device in the infrared-ray sensor is constituted by a photo diode made of InGaAs, for example, for making its sensitivity wavelengths longer, this reduces the resistance value of the parallel resistance therein, thereby inducing increased dark electric currents. Even with the infrared-ray sensor having such a structure, electric signals outputted from the infrared-ray reception device are caused to contain such increased dark electric currents, thereby inducing the problem of increases of errors in detection of the temperature of the cooking container.

To cope therewith, according to the present invention, the induction heating cookers described in the first to fourth embodiments employ an infrared-ray sensor as an infrared-ray detection portion having a structure which will be described later, which enables detecting the temperature of the cooking container with higher accuracy. Hereinafter, an induction heating cooker according to the fifth embodiment will be described, with respect to the concrete structure of the infrared-ray detection portion employed in the first to fourth embodiments.

Figure 10:
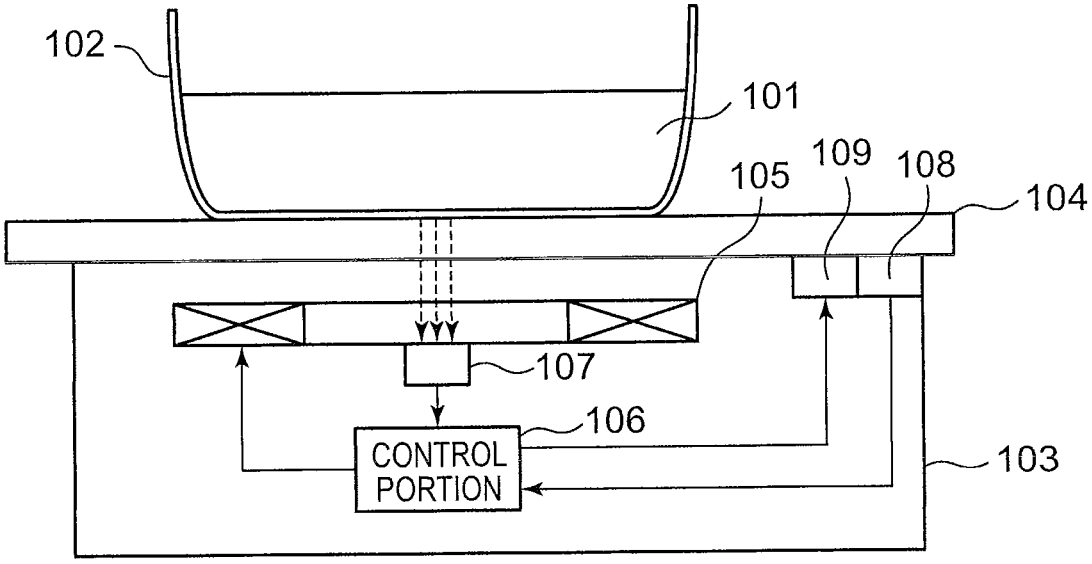
FIG. 10 is a block diagram schematically illustrating the structure of an induction heating cooker according to a fifth embodiment of the present invention.

FIG. 10 is a block diagram schematically illustrating the structure of the induction heating cooker according to the fifth embodiment of the present invention.

The induction heating cooker according to the fifth embodiment illustrated in FIG. 10 will be described in detail, with respect to the structure of the infrared-ray detection portion 107 in the induction heating cooker according to the first embodiment. Accordingly, the induction heating cooker according to the fifth embodiment has the same structure as that of the induction heating cooker according to the first embodiment. In the following description about the fifth embodiment, the components having the same functions and structures as those of the induction heating cooker 1 according to the first embodiment will be designated by the same reference characters, and will not be described.

Referring to FIG. 10, the induction heating cooker according to the fifth embodiment includes an outer case 103, a top plate 104, a heating coil 105, a control portion 106, an infrared ray detection portion 107, an input portion 108, and a notification portion 109, similarly to the induction heating cooker according to the first embodiment. Further, in the induction heating cooker according to the fifth embodiment, a pan is placed as a cooking container 102 as an object to be heated, on the top plate 104.

In the induction heating cooker according to the fifth embodiment, the infrared-ray sensor as the infrared-ray detection portion 107 is enabled to detect the temperature of the cooking container 102 when it is at a temperature equal to or higher than 60° C., when receiving infrared-ray energy radiated from the cooking container 102 on the top plate 104 through the top plate 104.

Figure 11:
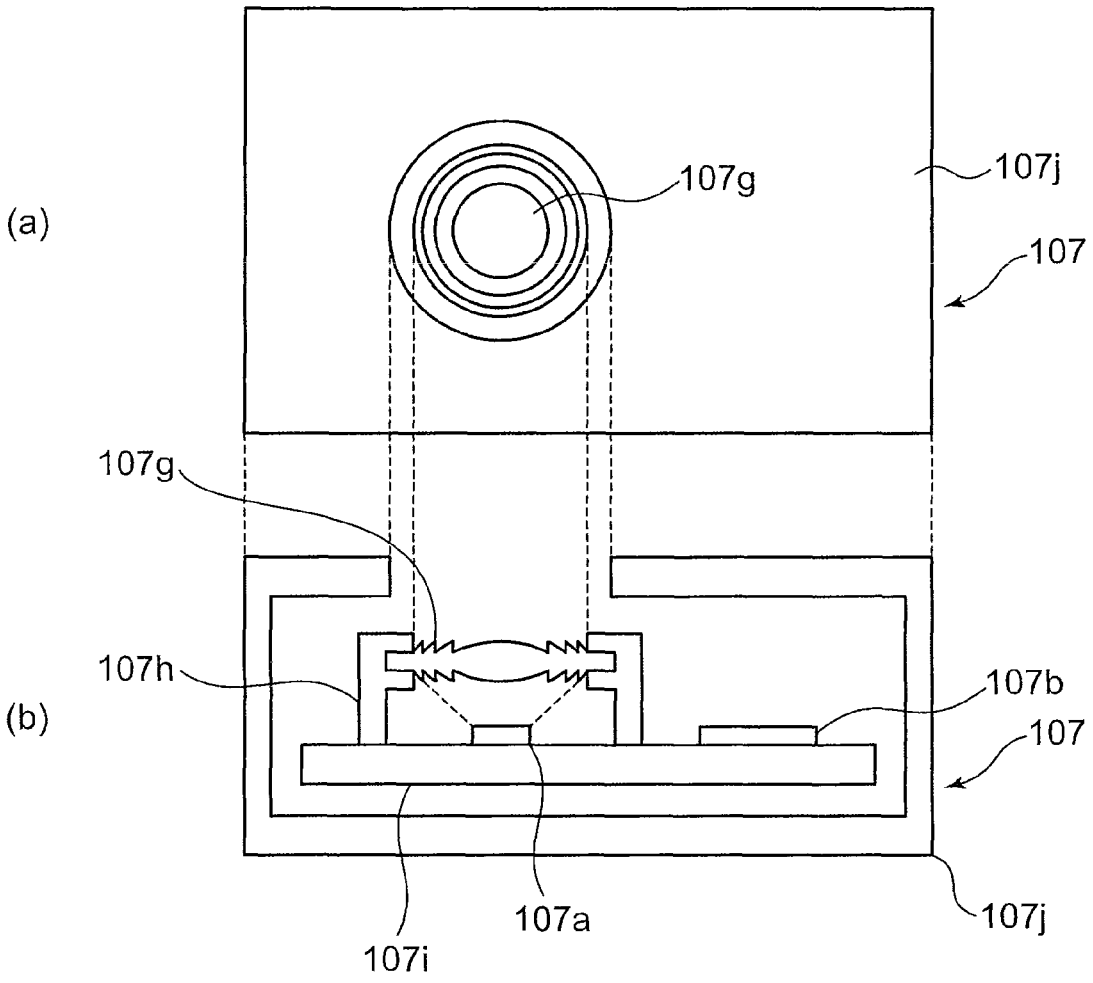
FIG. 11 is a view schematically illustrating the structure of an infrared-ray detection portion in the induction heating cooker according to the fifth embodiment.

FIG. 11 is a view schematically illustrating the structure of the infrared-ray sensor as the infrared-ray detection portion 107 in the induction heating cooker according to the fifth embodiment. (a) of FIG. 11 is a plan view of the infrared-ray detection portion 107, and (b) of FIG. 11 is a cross-sectional view of the infrared-ray detection portion 107.

Referring to FIG. 11, the infrared-ray detection portion 107 includes: an infrared-ray reception portion 107*a* constituted by an infrared ray reception device which has a maximum sensitivity wavelength in the range of 1.9 to 2.0 μm and is adapted to receive infrared rays radiated from the cooking container 102 through the top plate 104 and to convert the infrared ray energy of the received infrared rays into an electric signal; and an amplification portion 107*b* adapted to amplify the electric signal (the detection signal) outputted from the infrared-ray reception portion 107*a*. Further, the infrared-ray detection portion 107 employs a Fresnel lens 107*g* made of a resin, as a lens for condensing infrared rays having been radiated from the cooking container 102 and having transmitted through the top plate 104. The Fresnel lens 107*g* has a different light transmittance characteristic from that of the top plate 104 made of a heat-resistant glass.

As illustrated in (b) of FIG. 11, the Fresnel lens 107*g* is supported on a circuit board 107*i* through a supporting portion 107*h*. Further, the circuit board 107*i* is structured to electrically connect the infrared-ray reception portion 107*a* and the amplification portion 107*b* to each other and to support the infrared-ray reception portion 107*a* and the amplification portion 107*b* along with the supporting portion 107*h*.

As illustrated in Fig. (b) of 11, the circuit board 107*i* and the like are housed within an anti-magnetic case 107*j* for intercepting the induction magnetic field generated from the heating coil 105, so that infrared rays having been radiated from the cooking container 102 and having transmitted through the top plate 104 are passed through only the Fresnel lens 107*g* to be condensed to the infrared-ray reception portion 107*a*. Further, in FIG. 11, the shape of the Fresnel lens 107*g* is exaggeratedly illustrated, differently from its actual thin disk shape.

In the induction heating cooker according to the fifth embodiment, similarly to in the first embodiment, the outer case 103 is constituted by a metal case, and the top plate 104 is formed from a heat-resistant glass made of a crystallized glass plate having the trade name "Neoceram N-0". The control portion 106 is constituted by a microcomputer. The infrared-ray reception portion 107*a* in the infrared-ray detection portion 107 is constituted by a photo diode, which is a quantum-type infrared ray sensor. The amplification portion 107*b* is constituted by an operational amplifier.

The input portion 108, which is adapted to receive user's inputs, is constituted by a capacitance-type switch. The notification portion 109, which is adapted to generate notification of various information to the user, is constituted by an LCD (Liquid Crystal Display).

In the induction heating cooker according to the fifth embodiment, the Fresnel lens 107*g* in the infrared-ray reception portion 107 is constituted by a Fresnel lens made of polycarbonate with a thickness of 1 mm. The Fresnel lens is a lens with a smaller thickness which is formed by splitting an ordinary lens into concentric areas and, thus, the Fresnel lens has a fine sawtooth-shaped cross section. The anti-magnetic case 107*j* which houses the circuit board 107*i* and the like is constituted by a metal case made of aluminum. With the aforementioned structure, it is possible to easily realize the induction heating cooker according to the fifth embodiment.

Next, there will be described the induction heating cooker having the aforementioned structure according to the fifth embodiment of the present invention, with respect to operations thereof.

At first, the user selects a cooking menu and, then, performs a manipulation for starting heating, through the input portion 108. On receiving a signal for starting heating from the input portion 108, the control portion 106 operates a high-frequency inverter (not illustrated) for applying a high-frequency electric current to the heating coil 105, thereby starting an operation for heating the cooking container 102.

The cooking container 102 being heated by the heating coil 105 radiates infrared rays according to the temperature of the cooking container 102 itself. Infrared rays radiated from the cooking container 102 are reflected or absorbed by the top plate 104. The infrared rays absorbed by the top plate 104 are attenuated, and only infrared rays coincident to light transmittance characteristics of the top plate 104 are transmitted therethrough. At this time, the control portion 106 operates the infrared-ray detection portion 107, and portions of infrared rays transmitted through the top plate 104 are received by the infrared-ray detection portion 107, so that the temperature of the cooking container 102 is detected. The control portion 106 performs predetermined control according to the cooking menu selected by the user, based on the detected temperature of the cooking container 102.

Hereinafter, the infrared-ray detection portion 107 in the induction heating cooker according to the fifth embodiment will be described.

Infrared rays radiated from the cooking container 102 are partially transmitted through the top plate 104 to be attenuated thereby and, further, are received by the infrared-ray reception portion 107. Infrared rays transmitted through the top plate 104 are infrared rays in a certain wavelength range coincident to a light transmittance characteristic of the top plate 104. For example, in the case where the top plate 104 is made of a material with a thickness of 4 mm and with the trade name "Neoceram N-0", the light transmittance is about 90%, around 1.9 to 2.0 μm which is a wavelength range to which the infrared-ray reception portion 107*a* has maximum sensitivity.

The infrared rays transmitted through the top plate 104 are partially received by the infrared-ray detection portion 107 and, further, are condensed by the Fresnel lens 107*g*. In the Fresnel lens 107*g*, infrared rays coincident to light transmittance characteristics of the Fresnel lens 107*g* are transmitted therethrough to be condensed.

Infrared rays within a wavelength range of 1.9 to 2.0 μm, which is the maximum-sensitivity wavelength range of the infrared-ray reception portion 107*a*, are radiated from the cooking container 102 even when it is at temperatures lower than 60° C. However, even if such infrared rays are received by the infrared ray reception portion 107*a*, the infrared rays have an amount of energy which prevents the infrared-ray reception portion 107*a* from outputting a minimum necessary amount of electricity as electric signals.

In the induction heating cooker according to the fifth embodiment, the infrared-ray detection portion 107 employs the Fresnel lens made of polycarbonate with a thickness of 1 mm, as the condenser lens, which attains significant improvement for coping with attenuation in the condenser lens. In the infrared-ray detection portion 107, if infrared rays radiated from the cooking container 102 being at 60° C. are transmitted through the top plate 104 and the Fresnel lens 107*g* to be received by the infrared-ray reception portion 107*a*, even when they have infrared ray energy having a smaller value, the infrared-ray reception portion 107*a* can output a minimum necessary amount of electricity as electric signals.

The present inventors revealed facts as follows, from experiments. In cases of a conventional infrared ray sensor employing a convex lens made of polycarbonate with a thickness of 3 mm, as a condenser lens, when the infrared-ray reception portion received infrared rays radiated from the cooking container 102 being at 60° C. through the top plate 104 and the convex lens, it could not output a minimum necessary amount of electricity as electric signals. As described above, even when infrared rays radiated from the cooking container 102 being at 60° C. were received by the conventional infrared-ray sensor having a maximum sensitivity wavelength range of 1.9 to 2.0 μm, the conventional infrared-ray sensor could not output a minimum necessary amount of electricity as electric signals.

However, with the induction heating cooker according to the fifth embodiment, due to the use of the Fresnel lens 107*g* made of polycarbonate with a thickness of 1 mm, as a condenser lens, the infrared-ray reception portion 107*a* having a maximum sensitivity wavelength range of 1.9 to 2.0 μm could certainly output electric signals, when receiving infrared rays from the cooking container 102 being at 60° C.

Further, the convex lens made of polycarbonate with a thickness of 3 mm had a light transmittance of about 60%, for wavelengths of about 1.9 to 2.0 μm. On the other hand, the Fresnel lens 107*g* made of polycarbonate with a thickness of 1 mm had a light transmittance of about 90%, for wavelengths of about 1.9 to 2.0 μm. In this case, the light transmittance, which is a value indicating the degrees of absorbance and penetration of light by and through the object through which light is transmitted, represents the ratio of the amount of light penetrated through the object to the amount of light received by the object.

As described above, with the induction heating cooker according to the fifth embodiment, even when the top plate 104 made of a heat-resistant glass and the Fresnel lens 107*g* as the resin condenser lens have different transmittance characteristics, if the infrared-ray detection portion 107 receives infrared rays from the cooking container 102 at a lower temperature, it can detect the temperature of the cooking container 102 with higher accuracy, which can improve the cooking performance of the induction heating cooker.

Further, while the induction heating cooker according to the fifth embodiment has been described with respect to a case where the infrared-ray detection portion 107 having a maximum sensitivity wavelength range of 1.9 to 2.0 μm is adapted to detect the temperature of the cooking container 102 being at a lower temperature, which is 60° C., it is also possible to attain the same detection even when the lower temperature is 70° C., which can offer the same effects.

Further, the structure according to the fifth embodiment can be also adapted such that the Fresnel lens 107*g* in the infrared-ray detection portion 107 is provided with reflection reducing means for reducing reflections of infrared rays. As the reflection reducing means, it is possible to employ an AR coat (Anti-Reflection Coat), which is a thin film having the function of reducing reflections of infrared rays, which enables easily realizing this structure. As such an AR coat, it is possible to form, on the surface, for example, a transparent thin film, from magnesium fluoride, through vacuum vapor deposition, in order to reduce reflections using interference of light.

By forming such reflection reducing means on the surface of the Fresnel lens 107*g*, the reflection reducing means minimizes the reflection at the condenser lens, although infrared rays radiated from the cooking container 102 are transmitted through the top plate 104 to be attenuated thereby. This can further improve the accuracy of the temperature detection by the infrared-ray detection portion 107.

Further, the induction heating cooker according to the fifth embodiment has been described with respect to the case where the infrared-ray detection portion 107 has a maximum sensitivity wavelength range of 1.9 to 2.0 μm. However, in the present invention, the maximum sensitivity wavelength range is not limited to these wavelengths, and, for example, the infrared-ray reception portion can be adapted to have a maximum sensitivity wavelength range of 1.5 to 1.6 μm and can be adapted to detect the temperature of the cooking container 102 when it is at temperatures equal to or higher than 140° C.

Figure 12:
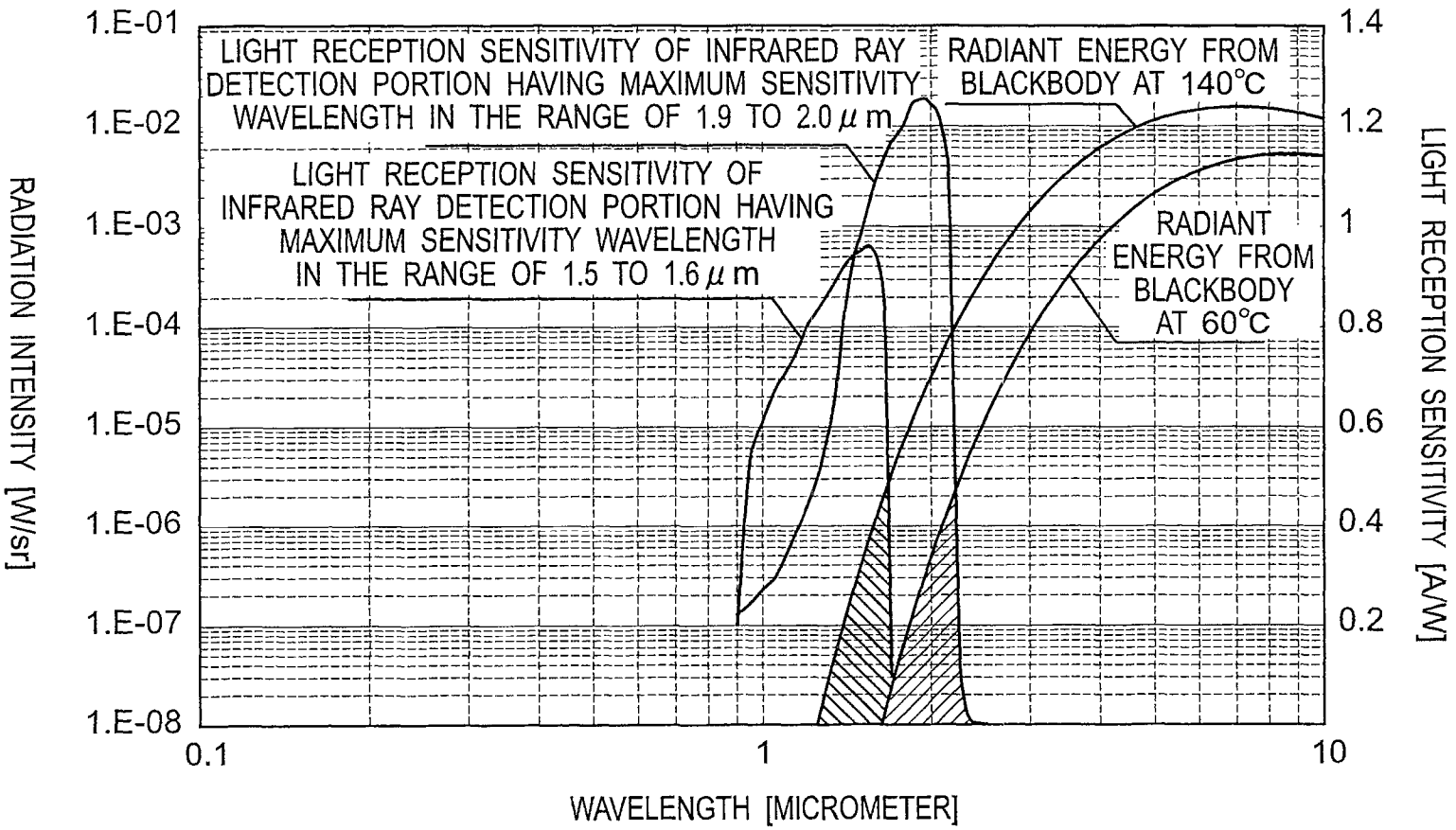
FIG. 12 is a graph illustrating curves of energy radiated from blackbodies at certain temperatures, and curves of light-reception sensitivity characteristics of the infrared-ray detection portion having certain maximum sensitivity wavelengths.

FIG. 12 illustrates curves of energy radiated from respective blackbodies at 60° C. and 140° C. and, further, illustrates curves of light-reception sensitivity characteristics of the infrared ray detection portion in the case where the infrared-ray reception portion has a maximum sensitivity wavelength in the range of 1.9 to 2.0 μm and in the case where it has a maximum sensitivity wavelength in the range of 1.5 to 1.6 μm. Referring to FIG. 12, the lateral axis represents the wavelength [micrometer], while the longitudinal axis represents the radiation intensity [W/sr] indicative of the radiant energy from the blackbodies and, further, represents the light reception sensitivity [A/W] of the infrared-ray detection portion 107.

Referring to FIG. 12, the curve of the radiant energy from the blackbody at 60° C. and the curve of the light-reception sensitivity characteristic in the case of the maximum sensitivity wavelength in the range of 1.9 to 2.0 μm are intersected and overlapped with each other over an area (a hatched area), which indicates the energy which can be received by the infrared-ray detection portion having the maximum sensitivity wavelength in the range of 1.9 to 2.0 μm. Similarly, the curve of the radiant energy from the blackbody at 140° C. and the curve of the light-reception sensitivity characteristic in the case of the maximum sensitivity wavelength in the range of 1.5 to 1.6 μm are intersected and overlapped with each other over an area (a hatched area), which indicates the energy which can be received by the infrared-ray detection portion having the maximum sensitivity wavelength in the range of 1.5 to 1.6 μm.

Infrared rays having wavelengths of 1.5 to 1.6 μm can be radiated from the cooking container 102 when it is at temperatures lower than 140° C. However, even if such infrared rays are received by the infrared ray reception portion having the maximum sensitivity wavelength in the range of 1.5 to 1.6 μm, the infrared rays have such energy as to prevent the infrared-ray reception portion from outputting a minimum necessary amount of electricity as electric signals.

The present inventors revealed the following fact, from experiments. In the case of a conventional infrared ray sensor employing a convex lens made of polycarbonate with a thickness of 3 mm, as a condenser lens, even when the infrared-ray reception portion having a maximum sensitivity wavelength in the range of 1.5 to 1.6 μm received infrared rays radiated from the cooking container 102 being at a temperature of 140° C., the infrared-ray reception portion could not output a minimum necessary amount of electricity as electric signals.

On the other hand, in the case of employing the Fresnel lens 107*g* made of polycarbonate with a thickness of 1 mm, as a condenser lens in the infrared-ray reception portion 107, when the infrared-ray reception portion 107*a* having a maximum sensitivity wavelength in the range of 1.5 to 1.6 μm received infrared rays from the cooking container 102 being at 140° C., the infrared-ray reception portion 107*a* could output a minimum necessary amount of electricity as electric signals.

Further, when the infrared-ray detection portion 107 including the infrared-ray reception portion 107*a* having a maximum sensitivity wavelength in the range of 1.5 to 1.6 μm was adapted to detect the temperature of the cooking container 102 when it is at temperatures equal to or higher than 70° C., it could detect it substantially similarly to when the cooking container 102 was at 140° C. Accordingly, even when the temperature of the cooking container 102 is to be detected when it is at temperatures equal to or higher than 70° C., it is possible to offer the same effects as those of when the temperature to be detected is 140° C.

Sixth Embodiment

Figure 13:
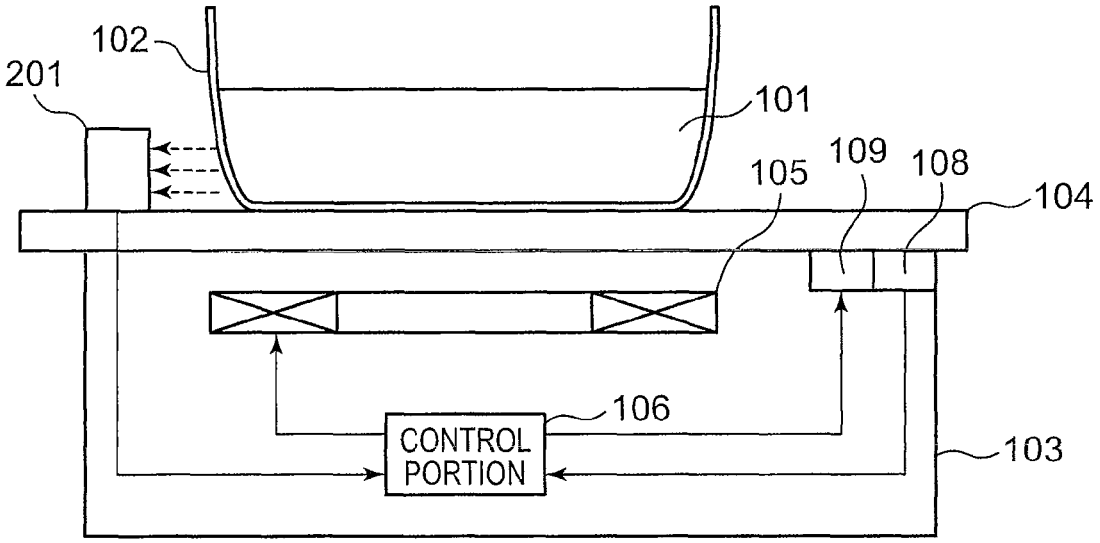
FIG. 13 is a block diagram schematically illustrating the structure of an induction heating cooker according to a sixth embodiment of the present invention.

FIG. 13 is a block diagram schematically illustrating the structure of an induction heating cooker according to a sixth embodiment of the present invention.

The induction heating cooker according to the sixth embodiment illustrated in FIG. 13 is different from the induction heating cooker according to the fifth embodiment, in that an infrared-ray detection portion 201 is provided on a top plate 104 and is adapted to directly detect infrared rays radiated from a cooking container 102. In the induction heating cooker according to the sixth embodiment, the infrared-ray detection portion 201 on the top plate 104 is adapted to detect the temperature of the cooking container 102, for controlling the temperature of the cooking container 102. Further, the infrared ray detection portion 201 according to the sixth embodiment is provided with a Fresnel lens for condensing infrared rays, similarly to the infrared ray detection portion 107 according to the fifth embodiment.

In the induction heating cooker according to the sixth embodiment, the other structures can be constituted by the same structures as those described in the aforementioned first to fifth embodiments. In the induction heating cooker according to the sixth embodiment, the components having the same functions and structures as those of the induction heating cookers according to the other embodiments, which are the first to fifth embodiments, will be described by being designated by the same reference characters.

Referring to FIG. 13, the induction heating cooker according to the sixth embodiment includes an outer case 103, a top plate 104, a heating coil 105, a control portion 106, an input portion 108, and a notification portion 109, similarly to the induction heating cooker according to the aforementioned fifth embodiment. Further, in the induction heating cooker according to the sixth embodiment, a pan is used, as a cooking container 102 as an object to be heated on the top plate 104.

In the induction heating cooker according to the sixth embodiment, the infrared ray sensor as the infrared-ray detection portion 201 is adapted to directly receive infrared ray energy radiated from the cooking container 102 on the top plate 104 and to detect the temperature of the cooking container 102 when it is at a temperature equal to or higher than 60° C.

The induction heating cooker having the aforementioned structure according to the sixth embodiment is the same as the induction heating cooker according to the aforementioned fifth embodiment, in terms of operations. Therefore, operations of the sixth embodiment will not be described.

Hereinafter, the infrared ray detection portion 201 in the induction heating cooker according to the sixth embodiment will be described.

The cooking container 102 being heated by the heating coil 105 radiates infrared rays according to the temperature of the cooking container 102 itself. Infrared rays radiated into the air from the cooking container 102 are attenuated in the air. Since the cooking container 102 being heated is raised to a higher temperature, the infrared-ray detection portion 201 is provided at a position which is at a sufficiently-large distance from the cooking container 102, such that the infrared-ray detection portion 201 is at a temperature equal to or lower than the heat-resistant temperature of the infrared-ray detection portion 201. Therefore, infrared rays radiated from the cooking container are largely attenuated in the air and are received by the infrared-ray detection portion 201.

Further, the infrared-ray detection portion 201 has the same structure as that of the infrared-ray detection portion 107 which has been described with reference to FIG. 11 in the aforementioned fifth embodiment.

Infrared rays received by the infrared-ray detection portion 201 are condensed by the Fresnel lens 107*g* (see FIG. 11). Infrared rays coincident to the light transmittance of the Fresnel lens 107*g* are transmitted through the Fresnel lens 107*g* and are received by the infrared-ray reception portion 107*a*. In the induction heating cooker according to the sixth embodiment, the infrared-ray detection portion 201 employs the Fresnel lens 107*g* as a condenser lens, which minimizes the attenuation at the Fresnel lens 107*g*, so that about 90% of infrared rays received by the Fresnel lens 107*g* are transmitted therethrough and are incident to the infrared-ray reception portion 107*a*.

Since the induction heating cooker according to the sixth embodiment is structured as described above, it is possible to minimize the attenuation in the condenser lens in the infrared-ray detection portion 201, which enables the infrared-ray detection portion 201 to detect infrared rays with higher efficiency, thereby enabling detecting the temperature of the cooking container 102 with higher accuracy. Accordingly, with the structure according to the sixth embodiment, it is possible to improve the cooking performance of the induction heating cooker.

As described above, according to the present invention, in the induction heating cooker including the infrared-ray detection portion, even if the infrared-ray detection portion itself comes to be at a temperature in the temperature range to be detected thereby and, thus, a negative signal is superimposed on the infrared ray detection signal outputted from the infrared-ray detection portion, it is possible to detect the temperature of the cooking container with high accuracy, thereby improving the cooking performance.

According to the present invention, similarly to in the induction heating cookers described in the aforementioned embodiments, even when an infrared-ray detection portion is used in an infrared ray detection apparatus adapted such that the infrared-ray detection portion may come to be at temperatures in a temperature range to be detected thereby, it is possible to improve the accuracy of infrared ray detection. Accordingly, the present invention is also applicable to infrared ray detection apparatuses, as well as to induction heating cookers.

Further, according to the present invention, due to the use of the Fresnel lens as the condenser lens in the infrared-ray detection portion, it is possible to detect the temperature of the cooking container with higher accuracy, thereby further improving the cooking performance.

INDUSTRIAL APPLICABILITY

According to the present invention, it is possible to detect the temperature of a cooking container with higher accuracy, thereby further improving the cooking performance. Therefore, the present invention is applicable to induction heating cookers for use in ordinary households, restaurants, offices, and the like and, further, is applicable to infrared-ray detection apparatuses for detecting temperatures through infrared rays.

The invention claimed is:

1. An induction heating apparatus, comprising:

a top plate for placing an object to be heated thereon;

a heating coil adapted to generate an induction magnetic field for heating the object;

a control portion adapted to control a high-frequency electric current applied to the heating coil for heating the object; and an infrared-ray detection portion adapted to detect an infrared ray radiated according to a temperature of the object and to output an infrared-ray detection signal according to infrared-ray energy of the detected infrared ray;

wherein the infrared-ray detection portion includes:

an infrared-ray reception portion adapted to output a detection signal, when receiving an infrared ray radiated from the object, an amplification portion adapted to amplify the detection signal from the infrared-ray reception portion and output the infrared-ray detection signal, and a temperature detection portion adapted to detect a temperature of the infrared-ray reception portion and to output the detected temperature to the control portion, and wherein the control portion includes a correction portion adapted to correct the infrared-ray detection signal and output an infrared-ray real signal by using negative-signal information about a negative signal, which is superimposed on the infrared-ray detection signal output from the infrared-ray detection portion, and which has a reverse polarity from that of the infrared-ray detection signal, and the negative-signal information is generated in response to the temperature of the infrared-ray reception portion, when the temperature of the infrared-ray reception portion is equal to or higher than the temperature detected by the infrared-ray detection portion.

2. The induction heating apparatus according to claim 1, wherein the control portion includes a temperature-characteristic storage portion adapted to preliminarily store the negative-signal information indicative of a temperature characteristic regarding the negative signal and the temperature of the infrared-ray detection portion, and the correction portion is adapted to correct the infrared-ray detection signal by using the negative-signal information generated on basis of the temperature characteristic indicated by the negative-signal information stored in the temperature-characteristic storage portion, and the temperature of the infrared-ray reception portion is detected by the temperature detection portion.

3. The induction heating apparatus according to claim 1, wherein the control portion includes a sensitivity-characteristic storage portion adapted to preliminarily store the negative-signal information indicative of a sensitivity characteristic regarding the negative signal and a cutoff wavelength or a spectral sensitivity wavelength of the infrared-ray reception portion, and the correction portion is adapted to correct the infrared-ray detection signal based on the sensitivity characteristic indicated by the negative-signal information.

4. The induction heating apparatus according to claim 1, wherein the control portion is adapted to correct an input offset voltage signal contained in the infrared-ray detection signal.

5. The induction heating apparatus according to claim 1, wherein the infrared-ray detection portion is adapted to superimpose a constant reference voltage on the detection signal output from the infrared-ray reception portion.

6. The induction heating apparatus according to claim 1, further comprising a light interception portion adapted to prevent the infrared-ray reception portion from receiving an infrared ray radiated from the object, wherein the control portion includes:

a changeover portion adapted to manipulate the light interception portion for changing over between reception of an infrared ray radiated from the object by the infrared-ray reception portion and interception of the infrared ray, and a correction portion which is adapted to detect the negative signal superimposed on the infrared-ray detection signal, based on an output difference between an output signal from the infrared-ray reception portion, when the infrared-ray reception portion receives an infrared ray radiated from the object and an output signal from the infrared-ray reception portion when an infrared ray radiated from the object is intercepted and is adapted to correct the infrared-ray detection signal based on the detected negative signal, when the temperature of the infrared-ray reception portion is equal to or higher than a temperature detected by the infrared-ray detection portion.

7. The induction heating apparatus according to claim 1 further comprising:

a first infrared-ray reception portion adapted to detect an infrared ray radiated from the object according to the temperature of the object and is adapted to output an infrared-ray detection signal according to infrared ray energy of the detected infrared ray, a second infrared-ray reception portion near the first infrared-ray reception portion, that is shielded in such a way as to be prevented from receiving an infrared ray radiated according to the temperature of the object and is adapted to output a dark signal, and a correction portion which is adapted to detect the negative signal superimposed on the infrared-ray detection signal, based on an output difference between an infrared-ray detection signal from the first infrared-ray reception portion and the dark signal from the second infrared-ray reception portion and to correct the infrared-ray detection signal based on the detected negative signal when the temperature of the infrared-ray reception portion is equal to or higher than a temperature detected by the infrared-ray detection portion.

8. The induction heating apparatus according to claim 1, wherein the infrared-ray detection portion is further adapted to condense, by a Fresnel lens, an infrared ray radiated from the object and to output a detection signal from the infrared-ray reception portion.

9. The induction heating apparatus according to claim 1, wherein the infrared-ray detection portion is under the top plate and is adapted such that an infrared ray radiated from the object is incident to the infrared-ray detection portion through the top plate, and the incident infrared ray is condensed by a Fresnel lens having a different transmittance characteristic from that of the top plate, and a detection signal is output from the infrared-ray reception portion.

10. The induction heating apparatus according to claim 1, wherein the infrared-ray detection portion is on the top plate and is adapted such that an infrared ray radiated from the object is incident to the infrared-ray detection portion, the incident infrared ray is condensed by a Fresnel lens, and a detection signal is output from the infrared-ray reception portion.

11. The induction heating apparatus according to claim 1, wherein the infrared-ray detection portion is adapted such that an infrared ray radiated from the object is incident to the infrared-ray detection portion, the incident infrared ray is condensed by a Fresnel lens, and a detection signal is output from the infrared-ray reception portion, and the Fresnel lens is made of a resin.

12. The induction heating apparatus according to claim 1, wherein the infrared-ray detection portion is adapted such that an infrared ray radiated from the object is incident to the infrared-ray detection portion, the incident infrared ray is condensed by a Fresnel lens and, a detection signal is output from the infrared-ray reception portion, and the Fresnel lens has a thickness of 1 mm or less.

13. The induction heating apparatus according to claim 1, wherein the infrared-ray detection portion is of a quantum type.

14. The induction heating apparatus according to claim 1, wherein the infrared-ray detection portion is adapted to have sensitivity to temperatures of 100° C. or less.

15. The induction heating apparatus according to claim 1, wherein the infrared-ray detection portion has a maximum sensitivity wavelength in the range of 1.9 to 2.0 μm and is adapted to detect the temperature of the object when the object is at a temperature equal to or higher than 60° C.

16. The induction heating apparatus according to claim 1, wherein the infrared-ray detection portion has a maximum sensitivity wavelength in the range of 1.5 to 1.6 μm and is adapted to detect the temperature of the object when the object is at a temperature equal to or higher than 140° C.

17. The induction heating apparatus according to claim 1, wherein the infrared-ray detection portion is adapted such that an infrared ray radiated from the object is incident to the infrared-ray detection portion, the incident infrared ray is condensed by a Fresnel lens, and a detection signal is output from the infrared-ray reception portion, and the Fresnel lens includes a reflection reducing portion for reducing reflection of the infrared ray.

* * * * *